US007326101B2

(12) United States Patent
Engel et al.

(10) Patent No.: US 7,326,101 B2
(45) Date of Patent: Feb. 5, 2008

(54) SWITCHING ARRANGEMENTS AND ACCESSORIES CAPABLE OF ACTIVATION BY AIR

(76) Inventors: Robert W. Engel, 548 N. Hollyburne La., Thousand Oaks, CA (US) 91360; Robert Stephen Lee, 690 Bluegrass St., Simi Valley, CA (US) 93065; Steve G. Fouke, 14014 Panay Way, #283, Marina Del Rey, CA (US) 90292; John Rey Hollis, 21540 Encina Rd., Topanga, CA (US) 90290; William John Kelley, 1952 Corbett Highlands Pl., Arroyo Grande, CA (US) 93420

( * ) Notice: Subject to any disclaimer, the term of this patent is extended or adjusted under 35 U.S.C. 154(b) by 749 days.

(21) Appl. No.: 10/357,536

(22) Filed: Feb. 3, 2003

(65) Prior Publication Data

US 2003/0232567 A1 Dec. 18, 2003

Related U.S. Application Data

(60) Provisional application No. 60/353,882, filed on Feb. 2, 2002.

(51) Int. Cl.
*A63H 33/40* (2006.01)

(52) U.S. Cl. ..... 446/179; 446/91; 446/476; 446/324; 446/325

(58) Field of Classification Search ..... 446/175, 446/128, 90–91, 97, 118, 102, 297, 268, 179, 446/236

See application file for complete search history.

(56) References Cited

U.S. PATENT DOCUMENTS

| | | | | |
|---|---|---|---|---|
| 929,316 | A | 7/1909 | Masulla | |
| 983,608 | A | 2/1911 | Dayton | |
| 1,370,337 | A | 3/1921 | Megerlin | |
| 1,984,843 | A | 12/1934 | Schoenfeld | |
| 3,220,253 | A | 11/1965 | Parker | |
| 3,613,303 | A | 10/1971 | Allen | |
| 3,848,249 | A | 11/1974 | Meiri | |
| 4,373,290 | A | 2/1983 | Goldfarb et al. | |
| 4,579,281 | A * | 4/1986 | Karterman | 239/33 |
| 5,092,808 | A | 3/1992 | Takasaka et al. | |
| 5,545,071 | A * | 8/1996 | Shiraishi | 446/143 |

* cited by examiner

*Primary Examiner*—Eugene Kim
*Assistant Examiner*—Urszula M Cegielnik
(74) *Attorney, Agent, or Firm*—O'Connell Law Firm

(57) ABSTRACT

A switching arrangement capable of being actuated by an application of an air current with a playset component, a movable member for receiving an application of an air current relative to the playset component wherein the movable member for receiving an application of the air current is movable in response to the application of the air current, and an arrangement for actuating a response to a movement of the movable member for receiving an application of the air current. The switching arrangement can be electrical or non-electrical. Where the switching arrangement is electrical, it can cause an electrical signal to be produced in response to a sensed movement of the movable member.

22 Claims, 21 Drawing Sheets

FIG.12A
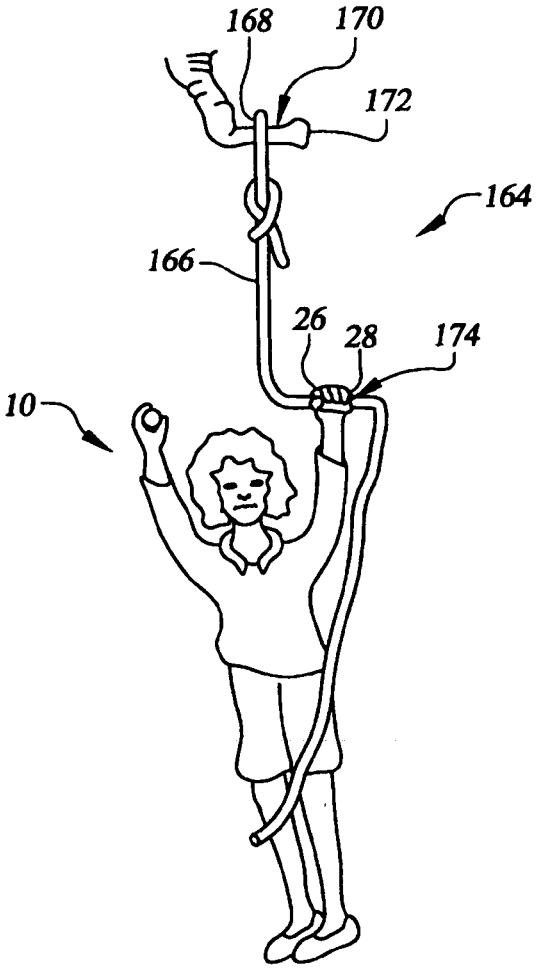
FIG.12B
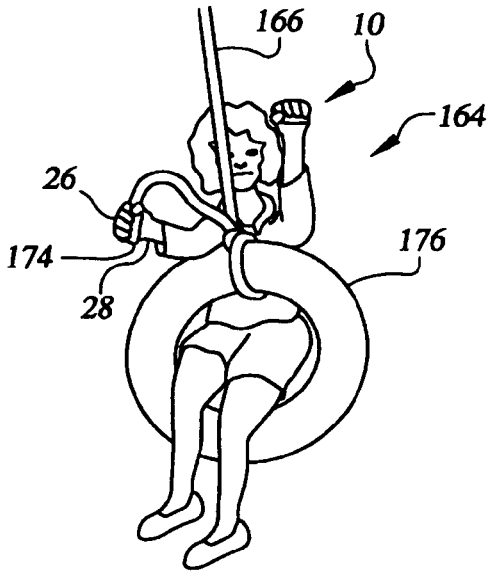
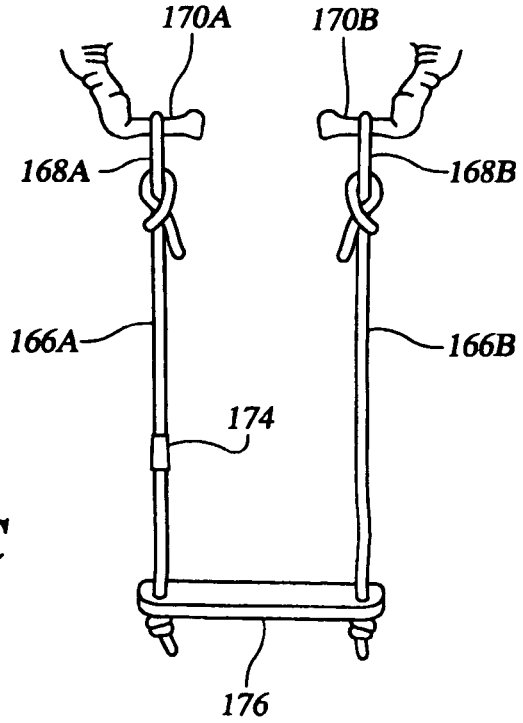
FIG.12C

SWITCHING ARRANGEMENTS AND ACCESSORIES CAPABLE OF ACTIVATION BY AIR

PRIORITY INFORMATION

This application claims priority to U.S. Provisional Patent Application No. 60/353,882, filed Feb. 2, 2002, which is incorporated herein by reference.

FIELD OF THE INVENTION

The present invention relates generally to playset arrangements. Stated more particularly, this patent discloses and protects embodiments of switching arrangements and accessories that are capable of being activated, actuated, or triggered by the application of one or more puffs or currents of air.

BACKGROUND OF THE INVENTION

It will be appreciated, of course, that the prior art discloses numerous playset constructions incorporating a wide variety of switching arrangements and accessories. However, it is equally clear that there remains a need for novel and useful switching arrangements and accessories that can be employed in various playset environments.

SUMMARY OF THE INVENTION

Advantageously, the present invention is founded on the most basic object of providing switching arrangements and accessories that represent an advance in the art of playset construction and design.

A more particular object of the invention is to provide switching arrangements and accessories that are capable of being actuated by the application of one or more puffs or currents of air.

A related object of the invention is to provide switching arrangements and accessories that can be actuated remotely by a user with only the application of air.

An additional related object of the invention is to provide switching arrangements and accessories that can be remotely triggered, activated, or actuated by air from a user's mouth by an action similar to a blowing of a kiss.

A further object of certain embodiments of the invention is to provide switching arrangements and accessories that can enable various playset effects.

A particular object of embodiments of the invention is to provide switching arrangements and accessories that can induce a variety of mechanical effects.

A particular object of further embodiments of the invention is to provide switching arrangements and accessories that can induce a variety of electronically controlled effects.

Another object of particular embodiments of the invention is to provide switching arrangements and accessories that can be operated in a simple, convenient, and effective manner.

These and further objects and advantages of the invention will become obvious not only to one who reviews the present specification and drawings but also to one who has an opportunity to make use of an embodiment of the present invention for switching arrangements and accessories that are capable of being activated or triggered by the application of one or more puffs or currents of air. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

One will appreciate that the foregoing discussion broadly outlines some of the more important goals of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

BRIEF DESCRIPTION OF THE DRAWINGS

In the accompanying drawing figures:

FIGS. 12A, 12B, and 12C are perspective views of embodiments of a swing

DETAILED DESCRIPTION OF PREFERRED EMBODIMENTS

As with many inventions, the present invention for switching arrangements and accessories that are capable of being actuated, activated, or triggered by the application of one or more puffs or currents of air can assume a wide variety of embodiments. However, to assist those reviewing the present disclosure in understanding and, in appropriate circumstances, practicing the present invention, certain exemplary embodiments of the invention are described below and shown in the accompanying drawing figures.

Figure 1A:
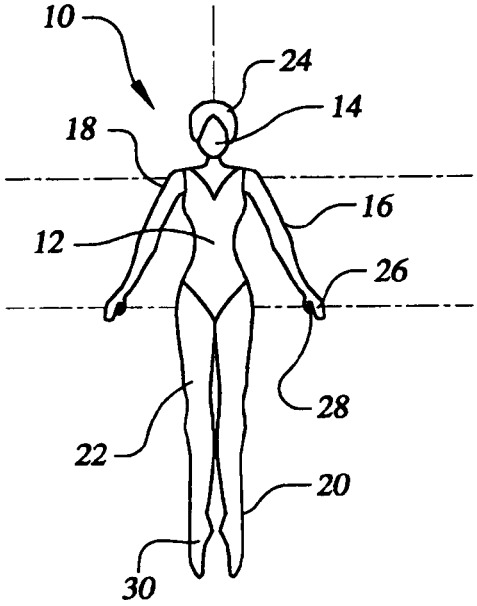
FIG. 1A is a view in front elevation of an acrobatic doll according to the present invention.
Figure 1B:
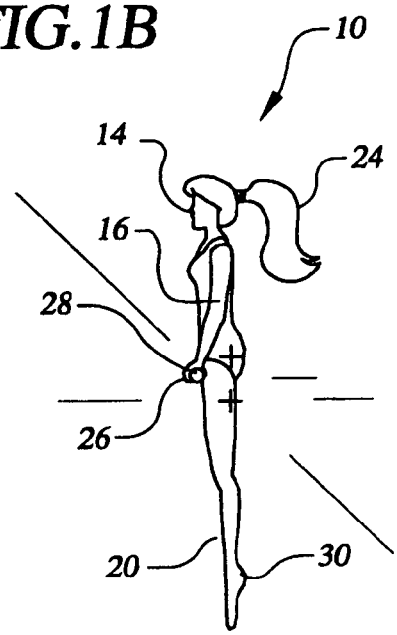
FIG. 1B is a view in side elevation of the acrobatic doll of FIG. 1A.
Figure 1D:
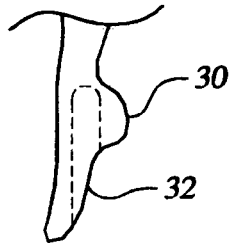
FIG. 1D is a view in side elevation of a foot of the doll of FIG. 1A.
Figure 1C:
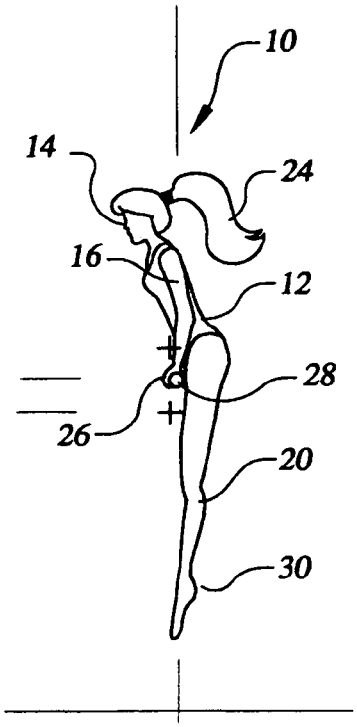
FIG. 1C is a further view in side elevation of the acrobatic doll of FIG. 1A in a detented configuration.

Looking more particularly to the drawings, a first embodiment of an acrobatic doll according to the present invention is indicated generally at 10 in FIGS. 1A, 1B, and 1C. This exemplary acrobatic doll 10 has a torso 12, a head 14, left and right arms 16 and 18, and left and right legs 20 and 22. Hair 24, which can comprise flexible, rooted strands of polymeric material, can be disposed on the head 14. The head 14 could be fixed to or formed integrally with the torso 12. Alternatively, the head 14 could be pivotally coupled to the torso 12 such that the relative orientations of the head 14 and torso 12 could be selectively adjusted. Similarly, the left and right arms 16 and 18 can be pivotally coupled to respective shoulder portions of the torso 12 while the left and right legs 20 and 22 could be pivotally coupled to hip portions of the torso 12 such that their relative positions can be readily manipulated. In this example, the arms 16 and 18 and the legs 20 and 22 are oppositely identical.

The torso 12, head 14, arms 16 and 18, and legs 20 and 22 can be formed from any appropriate material including, by way of example, plastic, rubber, metal, wood, a composite, or any other suitable material or combination of materials. Of course, although they could be formed from the same material, the torso 12, head 14, arms 16 and 18, and legs 20 and 22 could well be formed from different materials and with different material characteristics. For example, in one embodiment, the torso 12 can be crafted to be semi-rigid while the arms 16 and 18 and legs 20 and 22 can be formed as rigid members.

The left and right arms 16 and 18 can incorporate means for retaining the arms 16 and 18 in any one of a plurality of arm positions such that the arms 16 and 18 can be selectively positioned in various arm positions. Although a number of particular means would readily occur to one skilled in the art after reading this disclosure, one presently contemplated means comprises a plurality of detents incorporated into the junctions between the arms 16 and 18 and the respective shoulder portions of the torso 12. The detents could comprise any device, such as a catch, dog, or spring-operated ball, that could position and hold the arms 16 and 18 and the torso 12 relative to one another while allowing the device to be released by a sufficient force being applied to the respective arm 16 or 18 or the torso 12. The arms 16 and 18 can be attached to the torso 12 to share a single axis of rotation that is perpendicular to the center plane of the doll 10. As the arms 16 and 18 pivot relative to the torso 12, a given, fixed acute angle is maintained between the arms 16 and 18 and the center plane of the doll 10.

The left and right legs 20 and 22 also incorporate means for retaining the legs 20 and 22 in any one of a plurality of leg positions. Again, numerous such means would be possible including a plurality of detents incorporated into the junctions between the legs 20 and 22 and the torso 12. The legs 20 and 22 can be attached to the torso 12 to share a single axis of rotation that is perpendicular to the center plane of the doll 10, and a fixed acute angle can be maintained between the legs 20 and 22 and the center plane of the doll 10 as the legs 20 and 22 are pivoted relative to the torso 12. The preferred detents in each of the shoulder and hip joints are capable of resisting being released while supporting at least the entire weight of the doll 10 while the doll 10 is supported by even just one arm 16 or 18 or just one leg 20 or 22 and while the doll 10 exerts a maximum force on the respective joint, such as while the doll 10 is disposed in a horizontal orientation.

In the embodiment of FIGS. 1A through 1C, each of the arms 16 and 18 terminates in a hand 26 that incorporates a female grip portion 28. As will be described further hereinbelow, the grip portions 28 can be employed to engage or receive appropriately sized and configured members, such as accessories or other gripped elements. The grip portions 28 can comprise opposed, resiliently deflectable members or fingers such that an accessory or other element to be gripped can be pressed or snapped into engagement with the grip portions 28.

Figure 2A:
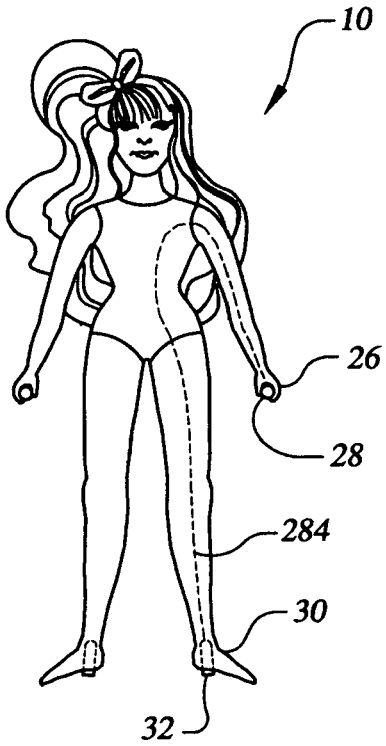
FIG. 2A is a view in front elevation of alternative acrobatic doll under the present invention.
Figure 2B:
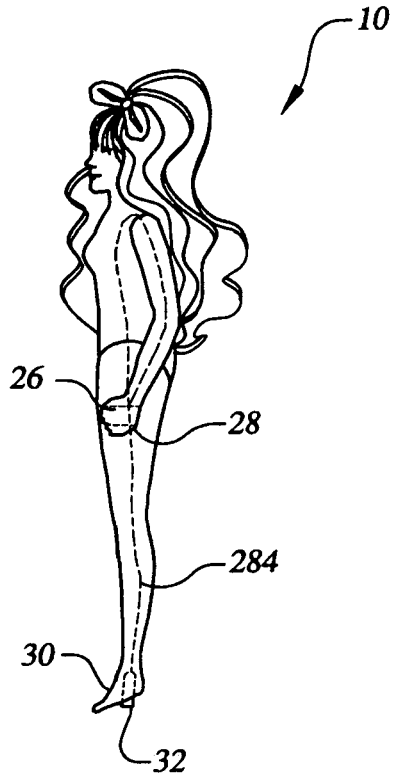
FIG. 2B is a view in side elevation of the acrobatic doll of FIG. 2A.

Each grip portion 28 can be considered to have a grip orientation along which a member can be received or engaged. In the embodiment of FIGS. 1A, 1B, and 1C, each of the hands 26 has a grip portion 28 with a grip orientation that is perpendicular to the center plane of the doll 10. However, it will be appreciated that the hands 26 could have grip portions 28 with different orientations. For example, each of the grip portions 28 could have grip orientations that are generally parallel to the center plane of the doll 10 as is shown in FIGS. 2A and 2B. Furthermore, one grip portion 28 could have a first orientation, such as generally parallel to the center plane of the doll 10, while the other grip portion 28 could have a second orientation, such as generally perpendicular to the center plane of the doll 10.

Where the arms 16 and 18 are retained as described above and where a grip portion 28 has a grip orientation that is perpendicular to the center plane of the doll 10, the grip portion 28 can retain the accessory or gripped element in a perpendicular relationship relative to the center plane of the doll 10 without regard to the angular disposition of the arm 16 or 18. Where the grip portion 28 has a grip orientation that is generally parallel to the center plane of the doll 10, the grip portion 28 can retain the accessory or gripped element in a parallel relationship relative to the center plane of the doll 10.

Each of the legs 20 and 22 terminates in a foot 30 that incorporates a female recess 32, which can be employed to receive and possibly frictionally engage appropriately sized and configured projections as will be discussed more fully below. In this case, each recess 32 is disposed through the sole of each foot 30. Each recess 32 can be considered to have a recess orientation along which a projection can be received. In this example, each recess 32 has a recess orientation that is generally parallel to the center plane of the doll 10.

As FIGS. 1B and 1C show, the arms 16 and 18 can be disposed and retained by a detent in a lowered position where the hands 26 are disposed just below and forward of the hips on the torso 12. When the arms 16 and 18 are so positioned and where one or both grip portions 28 has a grip orientation that is perpendicular to the center plane of the doll 10, the doll 10 can be caused to have a pivot axis that is coincident with the grip orientation of the grip portions 28 and perpendicular to the center plane of the doll 10. Advantageously, the location of the center of gravity of the doll 10 can be adjusted by a manipulation of the configuration of the doll 10 and by a control of the relative weights of the elements of the doll 10. For example, when the doll 10 is configured as is shown in FIG. 1B, the center of gravity will be slightly below and behind the pivot axis, and that location of the center of gravity can be ensured if necessary by a weighting of the legs 20 and 22. When the doll 10 is configured as is shown in FIG. 1C, the center of gravity can be caused to be slightly below but essentially directly under the pivot axis by a pushing of the legs 20 and 22 into a slightly forward detent position. With that, the doll 10 can be freely tumbled or rotated about the pivot axis as will be described below while tending each time to come to rest in an upright position.

Figure 1E:
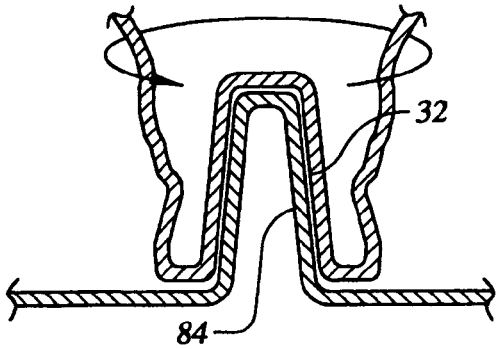
FIG. 1E is a sectional view in side elevation of a projection member frictionally engaged with a recess.

The grip portions 28 and the recesses 32 can each be considered to define or surround a reception volume of a given shape and size. While the reception volumes could vary as between the left and right grip portions 28 and the left and right recesses 32, the reception volumes can be matched in shape and size and that shape and size can mirror the shape and size of the accessories and other elements that are to be gripped or received by the grip portions 28 and the recesses 32. For example, the grip portions 28 and the recesses 32 could define a cylindrical reception volume, a tapered reception volume, or any other appropriate shape. As FIG. 1E shows most clearly, a projection 84 from a playset element can be shaped and sized to be received into a recess 32 in tight frictional engagement.

Exploiting the common sized grip portions 28 and, additionally or alternatively, the recesses 32, the doll 10 can be enabled to perform a wide variety of acrobatic tricks and maneuvers. For example, in FIGS. 3A and 3B, one sees first a tumble baton 34 alone and then the tumble baton 34 held by the doll 10 by being engaged with the grip portions 28. The tumble baton 34 is founded on an elongate rigid baton shaft 36 that has left and right proximal and distal annular protuberances 38 and 40 that subdivide the baton shaft 36 into a central grip portion 42 between the proximal annular protuberances 38 and distal bearing portions 44 between the proximal and distal annular protuberances 38 and 40. The central grip portion 42 can incorporate male inserts corresponding in size and shape to the reception volume defined by the grip portions 28 of the doll's hands 26.

In this exemplary embodiment, the baton shaft 36 is roughly as long as the doll 10 is tall. The protuberances 38 and 40 could be formed in a number of ways that would readily occur to one skilled in the art. Under one embodiment, for example, the protuberances 38 and 40 could be formed by appropriately sized annular beads that could be slid over the baton shaft 36. The protuberances 38 and 40 could be fixed relative to the baton shaft 36 or they could be allowed to rotate independently of the baton shaft 36 such that they could rotate to act as small wheels where necessary or desirable. The central grip portion 42 and the distal bearing portions 44 could simply comprise portions of the baton shaft 36 or they could comprise cylinders slid into place over the baton shaft 36 and fixed in place or left to rotate freely. The baton shaft 36 itself could be formed of any suitable material including, for example, a continuous length of relatively small gauge steel wire.

Figure 3A:
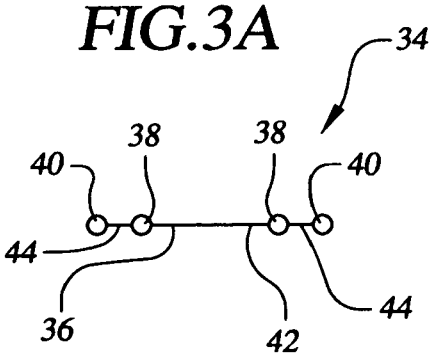
FIG. 3A is a view in front elevation of a tumble baton according to the present invention.
Figure 3B:
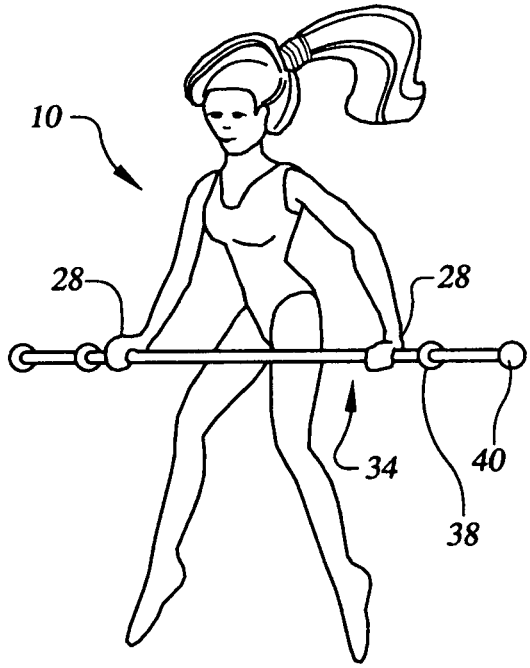
FIG. 3B is a perspective view of the an acrobatic doll according to the present invention shown engaged with the tumble baton of FIG. 3A.
Figure 5:
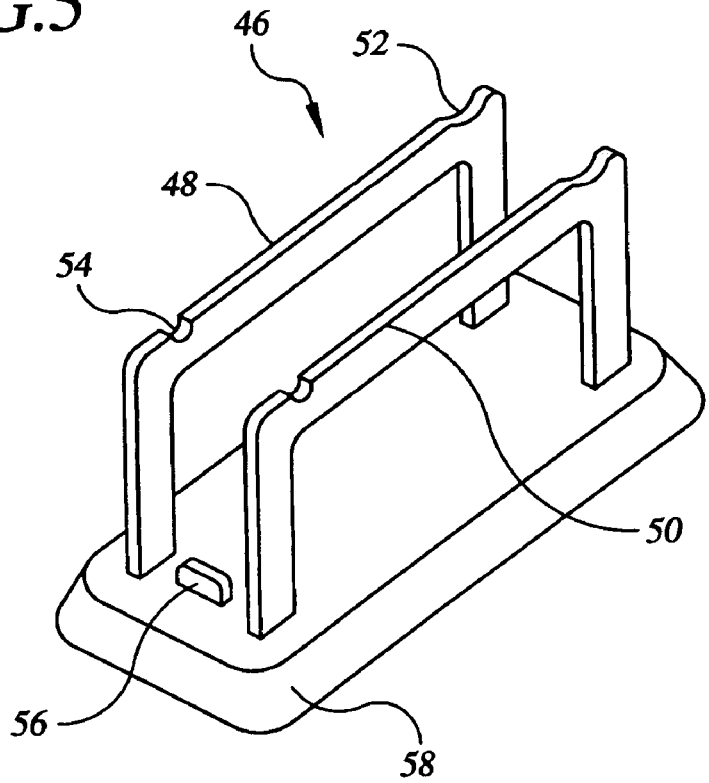
FIG. 5 is a perspective view of a tumble bar arrangement according to the present invention.

Under this arrangement, the tumble baton 34 can be snapped into place within the grip portions 28 of the doll 10 as is shown in FIG. 3B and the configuration of the doll 10 can be manipulated as may be desirable or necessary to allow a tumbling of the doll 10 when the tumble baton 34 is appropriately supported, such as by a support of the distal bearing portions 44. That support could be carried out in a variety of ways including, by way of example, the tumble bars indicated generally at 46 in FIG. 5. The tumble bars 46 have first and second generally parallel support rails 48 and 50 each with a first end and a second end. The support rails 48 and 50 are supported by a base 58 and are separated by a distance corresponding to the distance between the distal bearing portions 44. The support rails 48 and 50 can decrease in height from their first to second ends. The support rails 48 and 50 can have relatively shallow and smooth dips 52 adjacent to their first ends and more pronounced grooves 54 adjacent to their second ends. Also, a foot stop 56 can rise from the base 58.

With this, a doll 10 holding the tumble baton 34 can be disposed on the tumble bars 46 with the distal bearing portions 44 resting on the first and second support rails 48 and 50 and the proximal and distal annular protuberances 38 and 40 straddling the support rails 48 and 50 to retain the doll 10 aligned between the support rails 48 and 50. With the doll 10 configured to have a center of gravity very close to its pivot line and provided the doll 10 is not disposed in the dips 52 or the grooves 54, the doll 10 can tumble along the support rails 48 and 50, such as away from their first ends and toward their second ends. The tumbling of the doll 10 can be assisted by gravity due to the lessening height of the support rails 48 and 50 and, if necessary or desirable, by a user's blowing air on or pushing the doll 10. When the doll 10 approaches the second ends of the support rails 48 and 50, its distal bearing portions 44 of the tumble baton 34 will tend to fall into the grooves 54 thereby preventing the doll 10 from falling from the tumble bars 46. Also, the spinning or tumbling of the doll 10 will tend to be stopped in an upright position by the foot stop 56 that rises from the base 58. If the user so desires, the distal bearing portions 44 of the tumble baton 34 can be disposed in the dips 52 on the support rails 48 and 50 such that the doll 10 can spin or tumble in place. Also, especially where the distal annular protuberances 40 are rotatable relative to the remainder of the tumble baton 34, the doll 10 can be tumbled and spun without use of the tumble bars 46 simply by a user's holding the distal annular protuberances 40 and causing the doll 10 to tumble, such as by pushing thereon or by a puff of air.

Figure 4A:
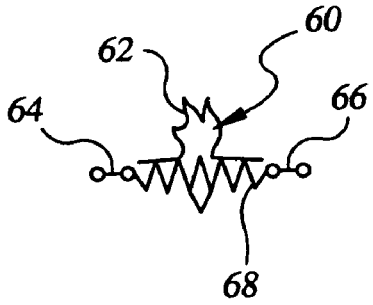
FIG. 4A is a view in front elevation of a tumble garment according to the present invention.
Figure 4B:
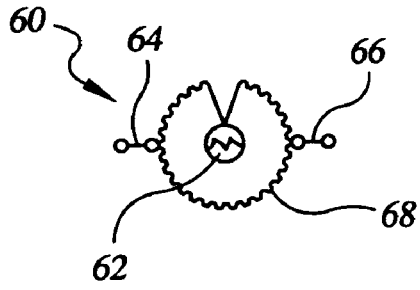
FIG. 4B is a top plan view of the tumble garment of FIG. 4A.

An alternative means for enabling the doll 10 to tumble, such as on the tumble bars 46, is shown in front and top views in FIGS. 4A and 4B in the form of a tumble garment 60 that can be removably and replaceably coupled to the doll 10. The tumble garment 60 is founded on a clip member 62 that has first and second lateral shafts 64 and 66 extending oppositely therefrom. Like the baton shaft 36, the first and second lateral shafts 64 and 66 have proximal and distal annular protuberances 38 and 40 disposed thereon. The clip member 62 can be formed from a resiliently deflectable material, such as plastic or a metal, with a slot therein such that it can be snapped onto the torso 12 of the doll 10. Although it need not be, the clip member 62 could be formed to match the shape of a corresponding portion of the torso 12 and possibly to simulate a portion of a clothing element as is shown in FIGS. 4A and 4B. Also, non-functional accessories, such as a textile skirt 68, can be coupled to the clip member 62 to allow the appearance of the doll 10 to be readily modified. When the tumble garment 60 is snapped into place on a doll 10, the doll 10 can be tumbled and spun as described previously relative to the tumble baton 34. The location of the first and second lateral shafts 64 and 66 relative to the clip member 62 and thus the doll 10 can be calibrated to provide a pivot axis that is just slightly but directly above the center of gravity of the doll 10 such that the legs 20 and 22 and other elements of the doll 10 need not be manipulated to adjust the center of gravity of the doll 10.

Figure 6A:
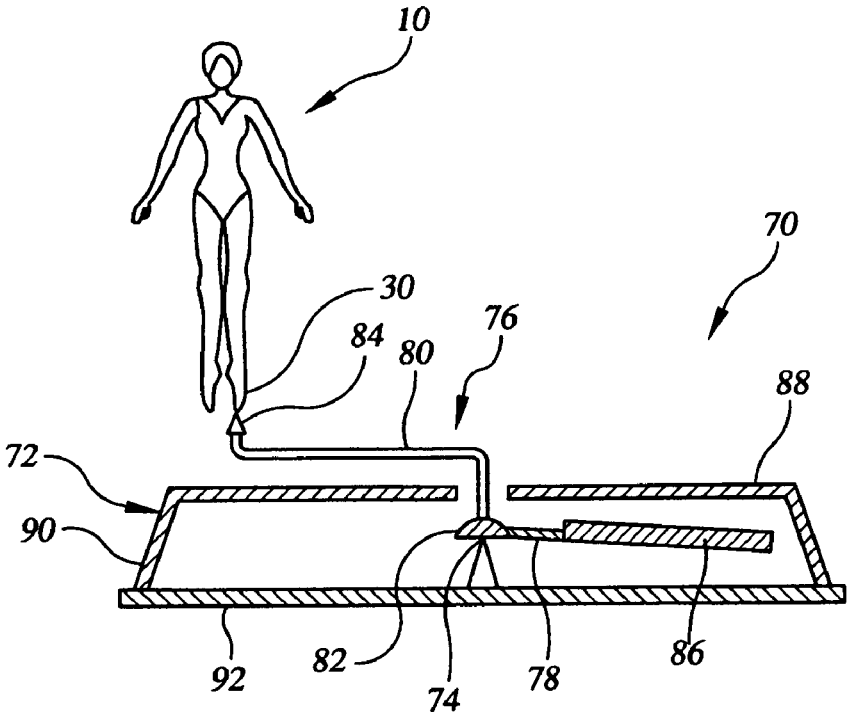
FIG. 6A is a sectioned view in side elevation of a dancing stand under the present invention.
Figure 6B:
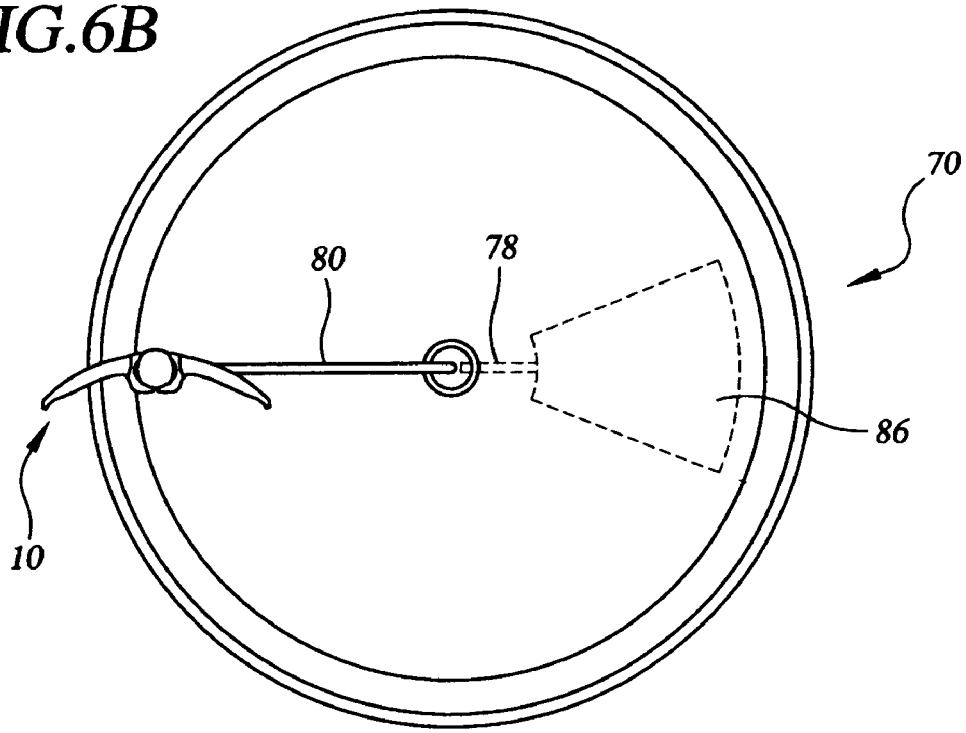
FIG. 6B is a top plan view of the dancing stand of FIG. 6A.
Figure 7A:
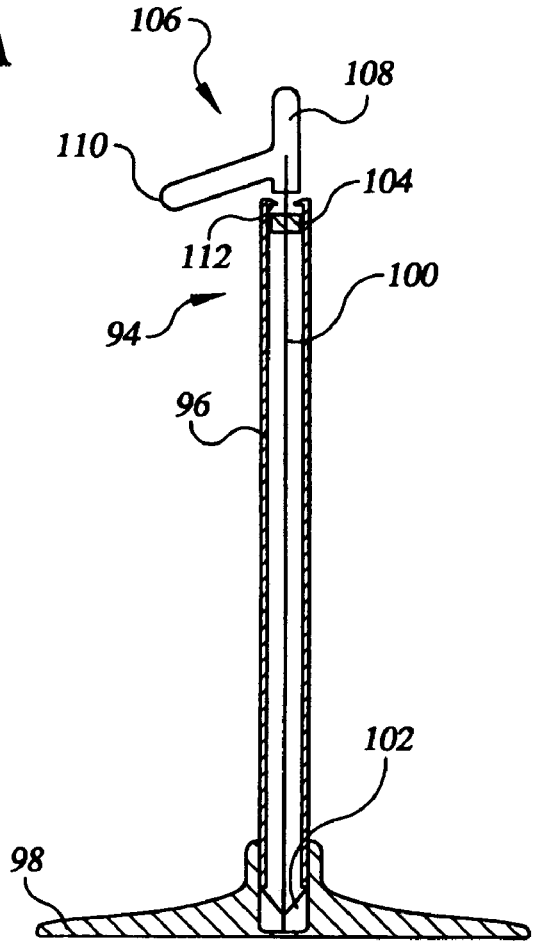
FIG. 7A is a sectioned view in side elevation of a vertical stand pursuant to the present invention.

The grip portions 28 and, alternatively or additionally, the recesses 32 can be employed for retaining the doll 10 relative to a variety of other accessories or elements. One alternative means for enabling the doll 10 to perform acrobatic tricks and maneuvers comprises what can be termed a dancing stand that is depicted generally at 70 in FIGS. 6A and 6B. The dancing stand 70 has a base 72 with an open inner volume defined by an upper plate 88, a peripheral wall 90, and a lower plate 92. A counterbalance arrangement 76 is supported by a fulcrum 74 with a smooth tip disposed within the base 72. More particularly, the counterbalance arrangement 76 has a pivot cap 82 that is rotatably retained atop the fulcrum 74. A counterbalance arm 78 with a counterweight 86 extends radially from the pivot cap 82 within the open inner volume of the base 72 while a doll support arm 80 extends radially through a central aperture in the upper plate 88 from the pivot cap 82 in a direction generally opposite to the counterbalance arm 78. A projection 84 extends generally vertically from the distal end of the doll support arm 80 for being received for frictional engagement into the recess 32 in one of the feet 30 of the doll 10 as is shown in FIGS. 6A and 6B or into one of the grip portions 28 of one of the hands 26 of the doll 10. The counterbalance arrangement 76 can be calibrated to retain the doll 10 in equipoise. When the doll 10 and the dancing stand 70 are so engaged, the doll 10 can be made to balance in a variety of configurations and can rotate freely on the dancing stand 70 while possibly bouncing up and down slightly thereby enabling the doll 10 to simulate a dancing motion. Advantageously, the doll 10 can be set into motion by lightly pushing on it, by a puff or air, or by any other effective means A further means for enabling the doll 10 to perform acrobatic tricks and maneuvers comprises what can be termed a vertical stand 94, which is shown in FIG. 7A and partially in FIGS. 7B and 7C. The vertical stand 94 has an elongate tubular housing 96 with an upper end and a lower end that is supported by a base 98. An axle 100 has a smooth lower end rotatably supported by a smooth conical bearing 102 and an upper end projecting beyond the upper end of the tubular housing 96. An annular axle retainer 104 surrounds the body portion of the axle 100 within the tubular housing 96 just below a narrowed neck 112 of the tubular housing 96 such that the axle 100 is maintained stably but rotatably while being prevented from being removed inadvertently from the tubular housing 96. A doll retaining member 106 with a vertical projection 108 and a slightly downwardly oriented lateral projection 110 is coupled to the upper end of the axle 100.

Figure 7B:
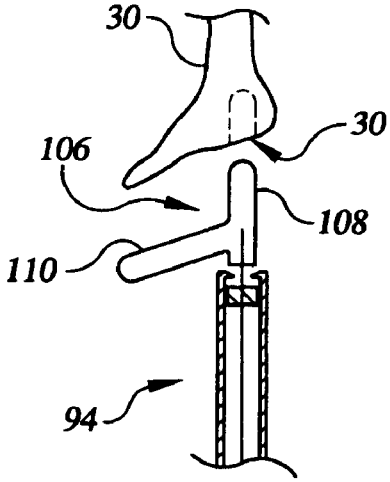
FIG. 7B is a sectioned view in side elevation of the vertical stand of FIG. 7A shown positioned to couple with a doll's foot.
Figure 7C:
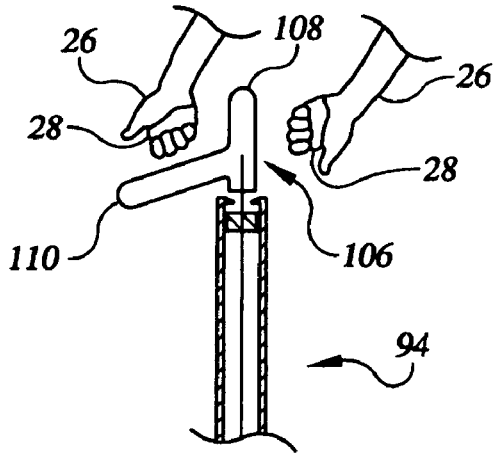
FIG. 7C is a sectioned view in side elevation of the vertical stand of FIG. 7A shown positioned to couple with a doll's hand in multiple orientations.
Figure 8A:
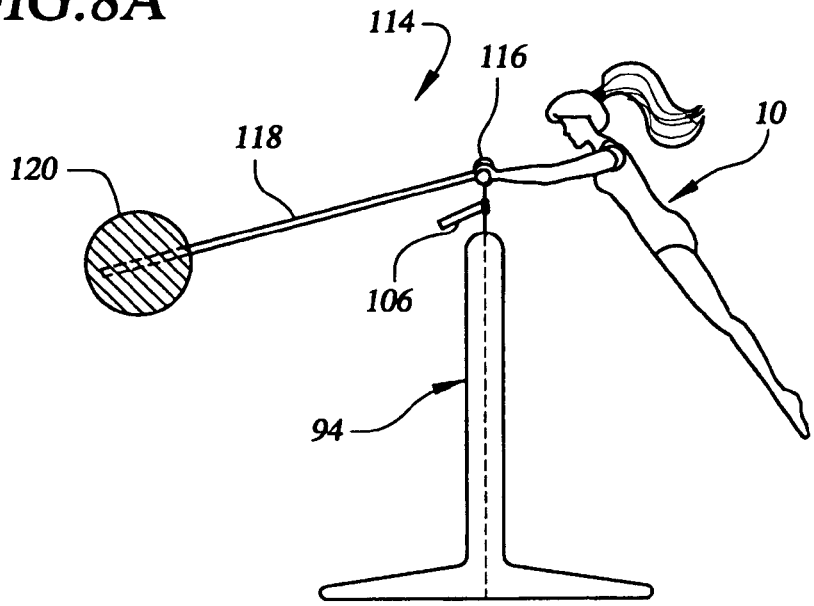
FIG. 8A is a view in side elevation of a doll balancing on the vertical stand of FIG. 7A by use of a balance wand.
Figure 8B:
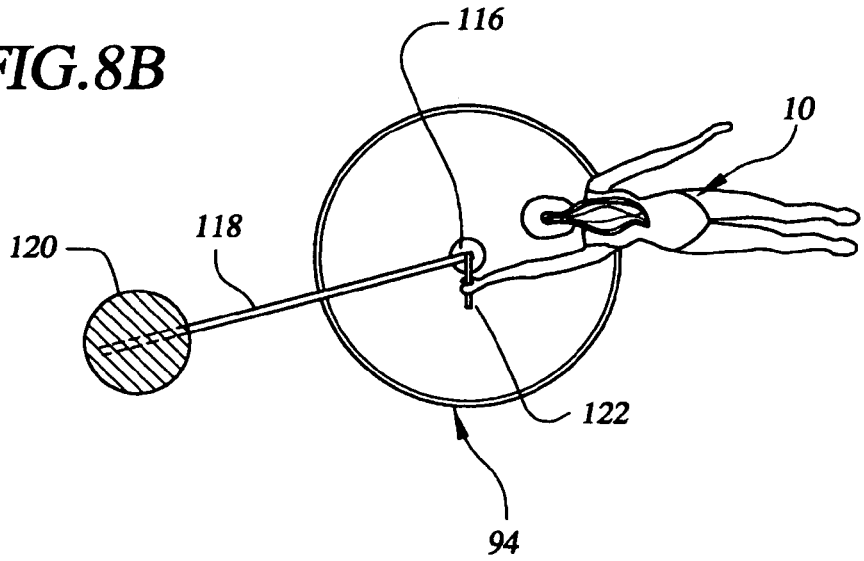
FIG. 8B is a top plan view of the doll balancing in FIG. 8A.
Figure 8C:
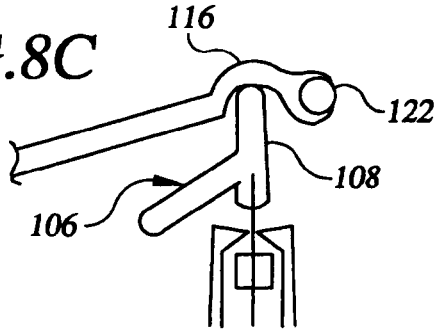
FIG. 8C is a partially sectioned view in side elevation of the retaining cap portion of the balance wand of FIG. 8A rotatably supported by the vertical stand.
Figure 8D:
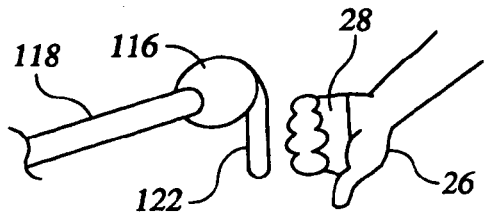
FIG. 8D is a plan view of a doll's hand positioned to engage the balance wand of FIG. 8A.

Employing such a vertical stand 94, a doll 10 can be engaged with the doll retaining member 106 by its hands 26 or feet 30 employing either the vertical projection 108 or the lateral projection 110. For example, as FIG. 7B shows, a foot 30 of the doll 10 can be frictionally engaged with the vertical projection 108 by sliding the vertical projection 108 into the recess 32. As FIG. 7C shows, a hand 26 of the doll 10 can be engaged with either the vertical projection 108 or the lateral projection 110 by sliding the respective projection 108 or 110 into the grip portion 28 or by snapping the grip portion 28 over the projection 108 or 110. As such, the doll 10 can be rotatably retained relative to the vertical stand 94 in a wide variety of orientations and configurations with little friction therebetween. Again, the doll 10 can be induced into rotation by being pushed, by a puff or air, or by any other effective means.

Another means for enabling the doll 10 to perform acrobatic tricks and maneuvers is shown in FIGS. 8A through 8D in the form of a balance wand 114 that can be used in combination with the vertical stand 94. The balance wand 114 has a shaft 118 with a proximal end coupled to a pivot cap 116 that has a smooth concave underside and a distal end coupled to a counterweight 120. The counterweight 120 can be made of any suitable material and with substantially any shape. For example, the counterweight 120 could be formed from a metal or it could comprise a sealed or sealable container for holding a fluid. The weight may be any of a number of shapes. A wand grip pin 122 projects from the pivot cap 116 for frictionally engaging the grip portion 28 of the hand 26 of the doll 10. Under this construction, the pivot cap 116 can be rotatably disposed over the vertical projection 108 of the doll retaining member 106 and the doll 10 and the counterweight 120 can be maintained in a balanced relationship. With that, the doll 10 can be induced to rotate about the stand 94 while possibly bouncing up and down by a light push, by a puff of air, or by any other effective method.

Figure 9A:
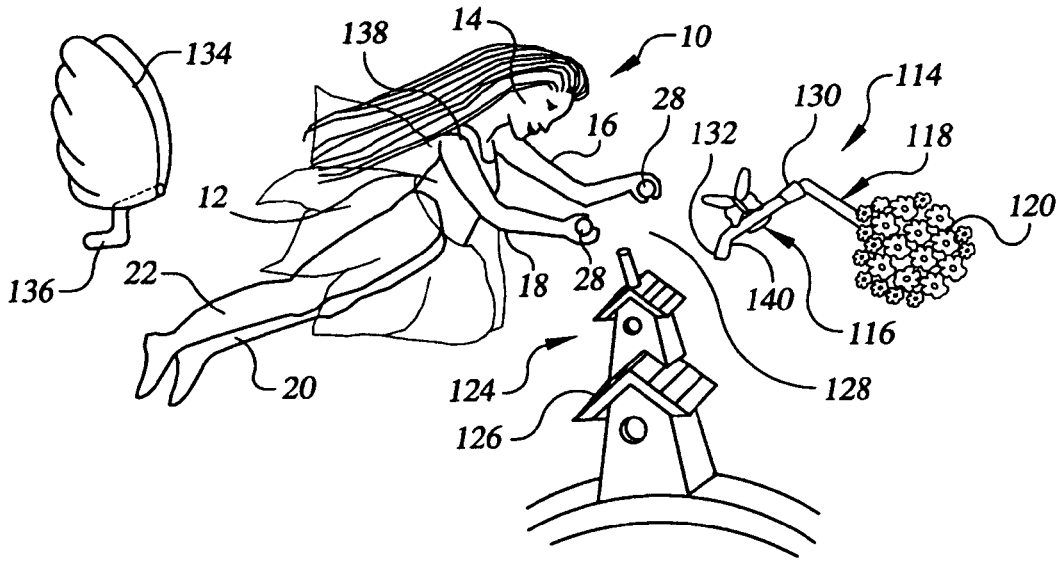
FIG. 9A is a pre-assembly perspective view of an alternative embodiment of the balance wand and vertical stand arrangement.
Figure 9B:
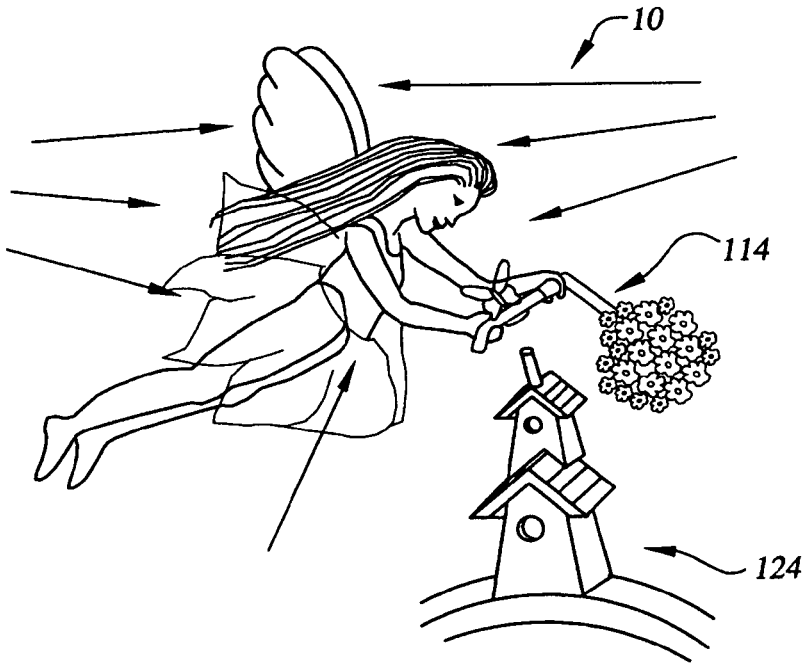
FIG. 9B is a perspective view of the alternative balance wand and vertical stand arrangement supporting a doll.

A related means for enabling the doll 10 to perform acrobatic tricks and maneuvers can be seen in FIGS. 9A and 9B where an alternative embodiment of the balance wand 114 is shown. There, the alternative version of the balance wand 114 again employs a pivot cap 116 for rotatably supporting the balanced doll 10 and counterweight 120. The pivot cap 116 certainly could be balanced atop a vertical stand 94 as described previously. In this embodiment, however, the pivot cap 116 is rotatably retained atop a decorative element 124 that has a body portion 126 simulating in this case a birdhouse and a smooth tip portion 128. The balance wand 114 has a first shaft 118 projecting from a first side of the pivot cap 116 and a second shaft 140 projecting from a second side of the pivot cap 116.

A first male insert 130 is disposed on the first shaft 118 and a second male insert 132 is disposed on the second shaft 140, and the first and second male inserts 130 and 132 are oriented orthogonally to one another, preferably perpendicularly. The left and right hands 26 of the doll 10 have grip portions 28 that also are oriented orthogonally relative to one another such that the grip portions 28 can be snapped over or otherwise engaged with the male inserts 130 and 132 to ensure that the doll 10 is supported most effectively. Also, the grip portions 28 have reception volumes that correspond in size and shape to the size and shape of the first and second male inserts 130 and 132. In this case, the grip portions 28 and the male inserts 130 and 132 have matching tapers to ensure a most effective connection.

In a further refinement, the doll 10 has a female receiver 138 disposed along a back portion of the doll 10 whether by being integrally formed therein or by being coupled thereto by a clip member such as that shown and described relative to the clip member 62 of the tumble garment 60. With this, a wing member 134 with a male member 136 can be removably and replaceably coupled to the doll 10 by an insertion of the male member 136 into the female receiver 138 or by any other appropriate coupling means. With or without the wing member 134, the doll 10 and the balance wand 114 can be induced into rotation and, possibly, vertical oscillation by a push on either element, by a puff of air, or by any other appropriate method.

The appearance and movement of the doll 10 and the balance wand 114 can be affected by a manipulation of the relative orientations of the arms 16 and 18, the legs 20 and 22, the torso 12, and the head 14. To facilitate this further, the arms 16 and 18 and legs 20 and 22 can be articulated at the elbows, knees, and, possibly, wrists. In each case, detents will preferably be incorporated to allow the respective elements to be selectively fixed in given positions. Advantageously, an articulated coupling of the wrists would enable the relative orientations of the hands 26 to be varied to, among other things, enable the grip portions 28 to engage accessories or other elements in a most versatile manner.

Figure 10A:
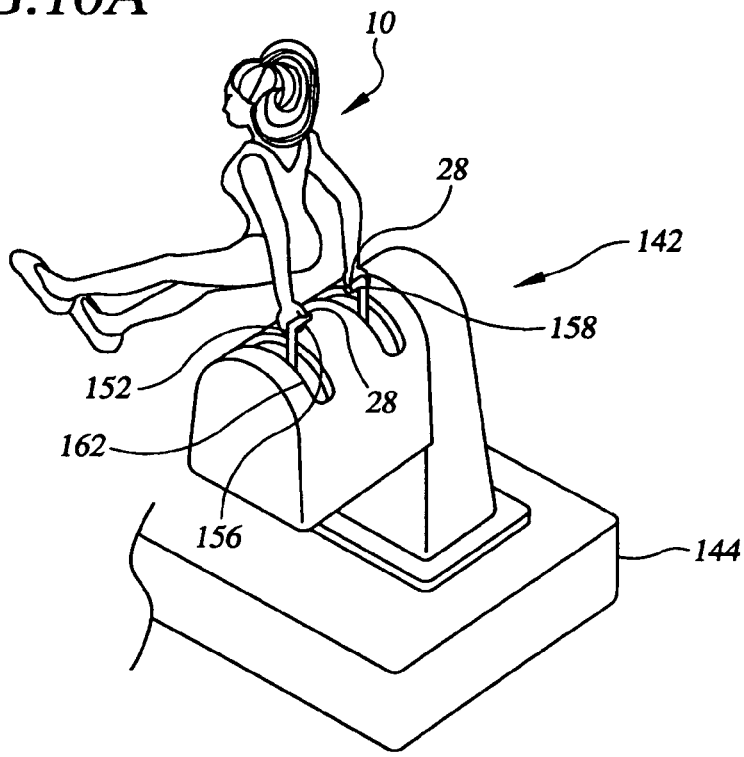
FIG. 10A is a perspective view of a doll supported by a rocker unit according to the present invention.
Figure 10B:
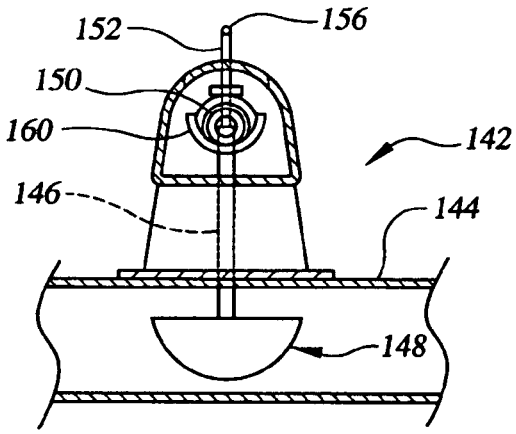
FIG. 10B is a sectioned view in side elevation of the rocker unit.
Figure 10C:
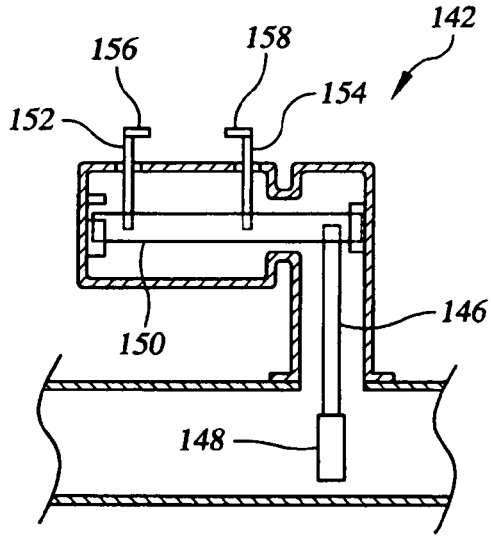
FIG. 10C is a sectioned view in front elevation of the rocker unit.

Yet another means for enabling the doll 10 to perform acrobatic tricks and maneuvers is shown in FIGS. 10A, 10B, and 10C in the form of a rocker unit 142 for enabling a doll 10 to rock back and forth by a counterweight arrangement. The rocker unit 142 has a base housing 144 with an open inner volume. An axle 150 is supported relative to the base housing 144 by an axle support 160. A connector rod 146 is fixed to the axle 150 and projects downwardly therefrom to retain a counterweight 148. First and second support rods 152 and 154 with first and second male inserts 156 and 158 project upwardly from the axle 150 to support a doll 10 by its grip portions 28 as is shown in FIG. 10A. Slots 162 are provided in the base housing 144 for allowing the first and second support rods 152 and 154 to travel therealong. The first and second male inserts 156 and 158 can be oriented orthogonally to one another, preferably perpendicularly, to provide most effective and stable support to the doll 10. Again, the first and second male inserts 156 and 158 and the grip portions 28 of the doll 10 can have matching shapes and sizes, in this exemplary case matching tapers, to ensure a most effective retention of the doll 10. Under this construction, the doll 10 can be induced into a rocking motion by a simple pushing on the doll 10, by a puff of air using the doll 10 as a sail, or by any other appropriate method.

Figure 11A:
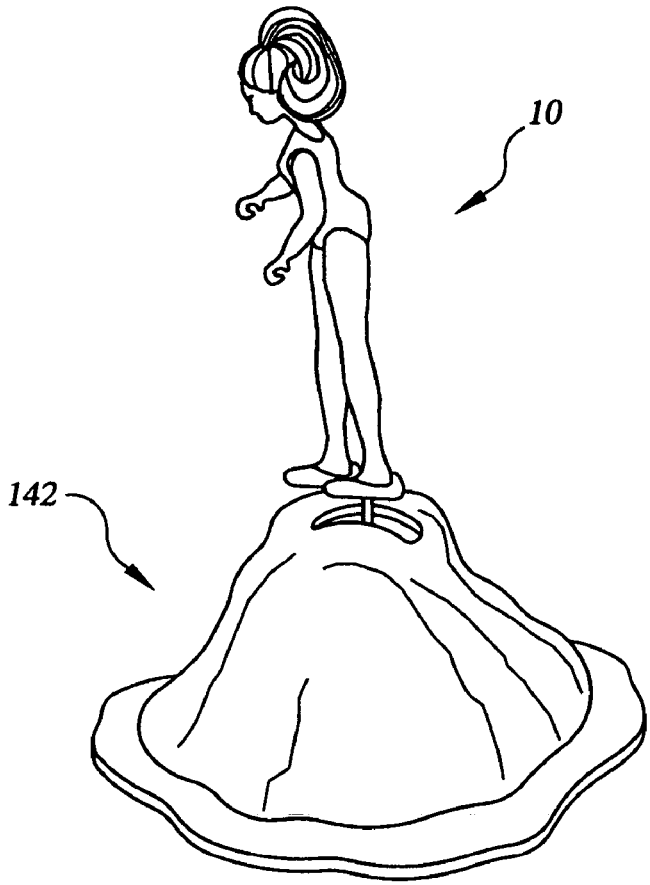
FIG. 11A is a perspective view of an alternative rocker unit shown supporting a doll.
Figure 11B:
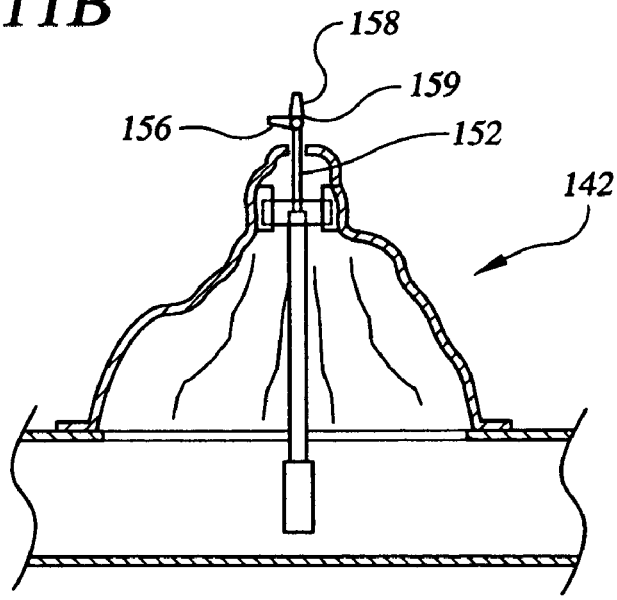
FIG. 11B is a sectioned view in side elevation of the alternative rocker unit of FIG. 11A.

Of course, while the rocker unit 142 simulates a gymnastic horse in FIGS. 10A through 10C, numerous other arrangements and simulations are possible and within the scope of the present invention. For example, as is shown in FIGS. 11A and 11B, the rocker unit 142 can have a base housing 144 simulating a hillside or the like and it can have just a first support rod 152. The first support rod 152 can have first, second, and possibly third orthogonally disposed male inserts 156, 158, and 159, each corresponding in size and shape to the commonly sized grip portions 28 of the hands 26 of the doll 10 and the commonly sized recesses 32 of the feet 30 of the doll 10. Under the exemplary arrangement of FIGS. 11A and 11B, the first and third male inserts 156 and 159 have orthogonal horizontal orientations while the second male insert 158 has a vertical orientation. As such, the doll 10 can be induced into a variety of acrobatic positions and maneuvers including, for example, the standing position shown in FIG. 11A where the first male insert 156 is inserted into the recess 32 in the left foot 30 of the doll 10. Alternatively, the doll 10 can be rocked back and forth in a handstand position with one of the first or third male inserts 156 or 159 frictionally retained in the grip portion 28 of one of the hands 26 of the doll 10.

An additional means for enabling the doll 10 to perform acrobatic tricks and maneuvers takes the form of a pendulum or swing arrangement 164, such as those shown in FIGS. 12A, 12B, and 12C. In FIG. 12A, for example, the swing arrangement 164 has a support member 166 that simulates a rope or vine. A loop 168 is simulated at an end of the support member 166 for being pivotally retained relative to a bearing surface 170, which would be supported by a further element of a playset (not shown). A protuberance 172 prevents the loop 168 from becoming dislodged during a swinging of the swing arrangement 164. The support member 166 has a lateral portion on which a male insert 174 is disposed. The male insert 174 again matches the reception volume defined by the grip portion 28 of the hand 26 of the doll 10 such that the hand 26 can be snapped over, slid onto, or otherwise engaged with the male insert 174 to retain the doll relative to the swing arrangement 164 most effectively.

Of course, the appearance and structure of the swing arrangement 164 could be varied widely within the scope of the invention. For example, as FIG. 12B shows, the swing arrangement 164 could further incorporate a swing member 176 with which the doll 10 could be associated. In this case, the swing member 176 simulates a tire of a tire swing that is retained by the support member 166. The support member 166 again has a male insert 174, which in this case is disposed on an extension portion of the support member 166. The doll 10 can thus be seated on the simulated tire swing member 176 with its hand 26 surrounding the male insert 174. Still further, as is depicted in FIG. 12C, the swing arrangement 164 could simulate a typical swing where the swing member 176 takes the form of a swing seat. In such a case, first and second support members 166A and 166B can be retained by first and second loops 168A and 168B relative to first and second bearing surfaces 170A and 170B. In each case, when the doll 10 is retained relative to the swing arrangement 164, it can be caused to swing by a simple push, by one or more puffs of air, or by any other method.

Figure 13A:
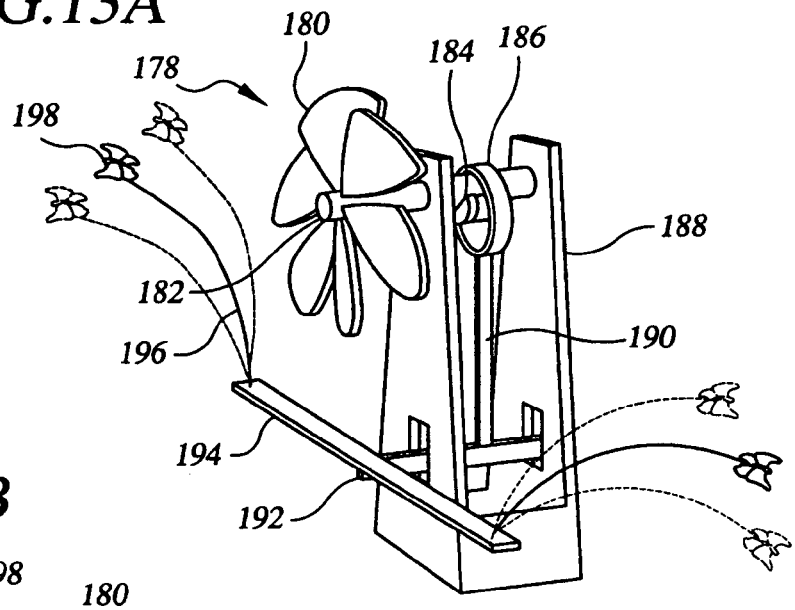
FIGS. 13A, 13B, and 13C are perspective views of embodiments of a propeller driven arrangement under the present invention.
Figure 13B:
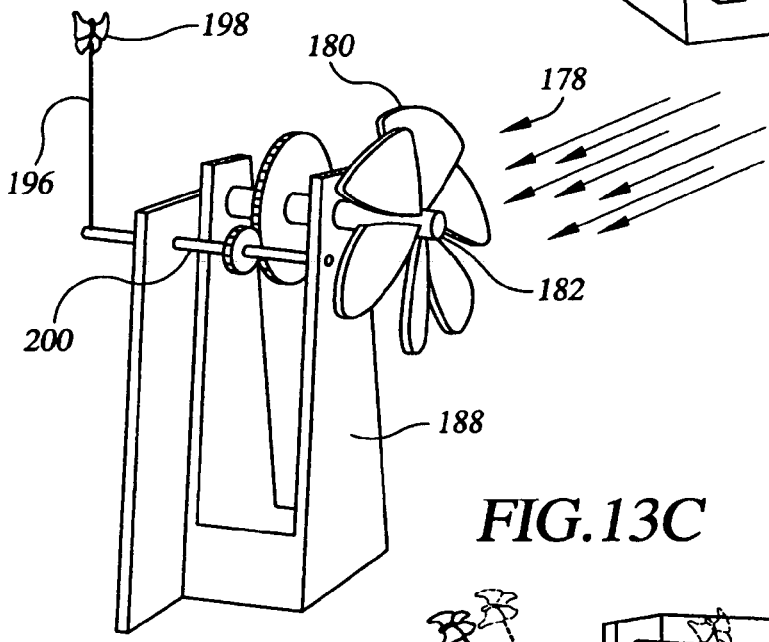
Figure 13C:
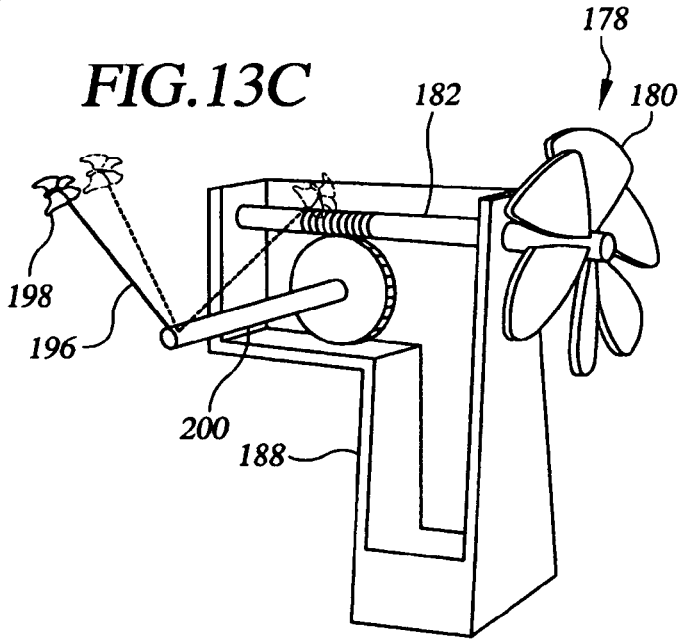

A further playset action that can be induced by one or more puffs of air can be carried out by a propeller driven arrangement, such as that indicated generally at 178 in FIGS. 13A, 13B, and 13C. In the embodiment of FIG. 13A, the propeller driven arrangement 178 has a propeller 180 retained on a propeller shaft 182 that is supported by a framework 188. A cam 184 is disposed on the propeller shaft 182, and a cam follower 186 comprising a loop rides on the cam 184. A connecting member 190 connects the cam follower 186 to a cross member 192, which in turn retains a support member 194. The support member 194 has one or more retaining shafts 196 retained thereon, and a decorative element 198, in this case a butterfly, is retained at the end of the retaining shafts 196. With such an arrangement, a user can impart a puff of air upon the propeller 180 to induce the propeller 180 and the propeller shaft 182 into rotation. The rotation of the propeller shaft 182 will induce a rotation of the cam 182 such that the cam follower 184 will rise up and down as it rides on the cam 182. The connecting member 190, the cross member 192, and the support member 194 will thus oscillate along with the cam follower 184. The oscillating movement of the support member 194 will result in a corresponding movement in the retaining shaft or shafts 196 and the retained decorative elements 198. Where the retaining shaft or shafts 196 are flexible in nature, the shaft or shafts 196 and decorative elements 198 will exhibit a random bouncing action effect.

The variation of the propeller driven arrangement 178 shown in FIG. 13B again has a framework 188 that rotatably retains a propeller shaft 182 that has a propeller 180 fixed thereto. In this case, however, the propeller shaft 182 is geared to a geared driven shaft 200. A shaft 196, which again can be flexible, extends radially from the driven shaft 200 and has a decorative element 198 retained at the distal end thereof. Under this construction, a user can impart a puff of air on the propeller 180 to cause it and the propeller shaft 182 to rotate. By its intermeshed gearing with the propeller shaft 182, the driven shaft 200 will be caused to rotate thereby causing the shaft 196 and the decorative element 198 to spin. By a relative sizing of the gearing, the proportional speed of rotation of the driven shaft 200 can be manipulated.

FIG. 13C depicts another variant of the propeller driven arrangement 178. A propeller 180 is drivingly coupled to a propeller shaft 182, which in turn is drivingly engaged with a driven shaft 200. In this case, that driving engagement is achieved by a worm gear arrangement. The driven shaft 200 again has a shaft 196 with a decorative element 198 extending therefrom. With this, one or more puffs of air imparted to the propeller 180 will induce it and the propeller shaft 182 into rotation thereby driving the driven shaft 200 and rotating the shaft 196 and the decorative element 198. It will be appreciated that the relative angular velocities can be manipulated by a proper crafting of the worm gear arrangement. As such, one will appreciate that the propeller driven arrangement 178 of FIG. 13C can be calibrated to demonstrate a relatively slow rotation of the decorative element 198 as compared to the propeller driven arrangement 178 of FIG. 13B, which would be likely to demonstrate a proportionally faster rotation of the decorative element 198.

Figure 14A:
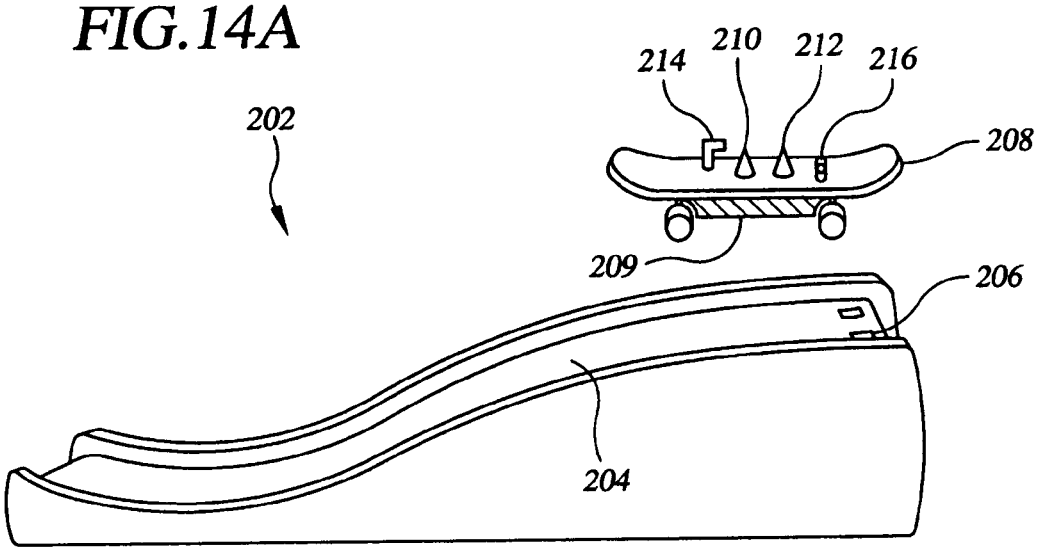
FIGS. 14A and 14B are perspective views of an air launch ramp arrangement according to the present invention first alone and then supporting a doll.
Figure 14B:
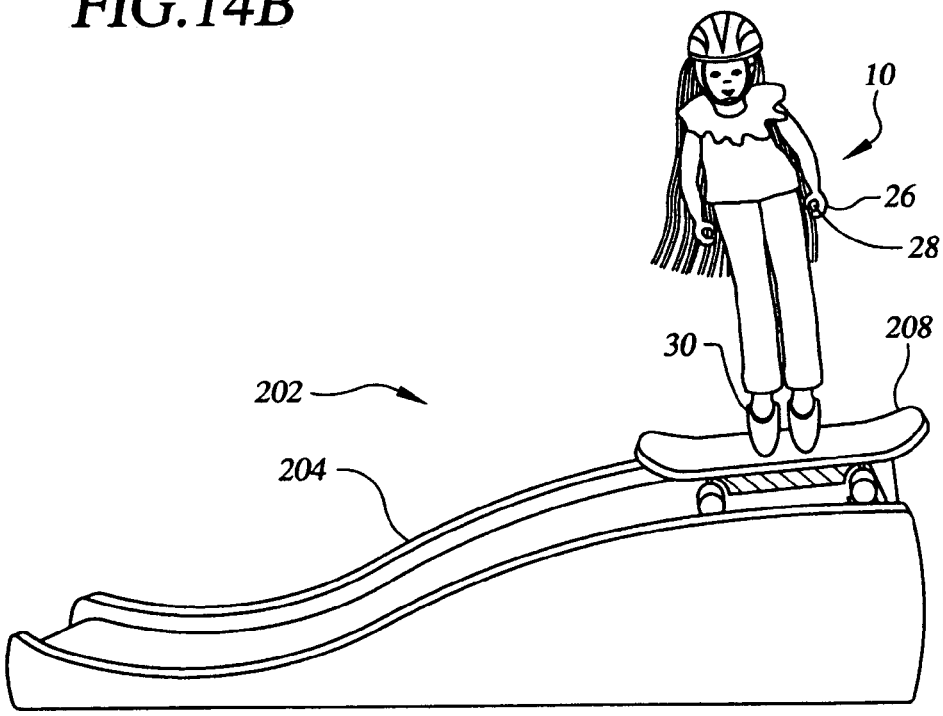

Another air activatable doll accessory in this case comprising an air launch ramp arrangement 202 is shown in FIGS. 14A and 14B. The air launch ramp arrangement 202 has a ramp 204 with a downslope, guide rails, and, possibly, one or more lips or jumps. Adjacent to an upper end of the ramp 204 is one or more shallow furrows 206 for temporarily retaining a wheel of a skateboard 208 or a portion of any other movable or slidable member, such as a ski, a sleigh, a bicycle, or any other movable or slidable member. The skateboard 208 has first and second male inserts 210 and 212 disposed thereon for engaging a hand 26 or foot 30 of a doll 10. The skateboard 208 also incorporates counterweight 209 to assist the doll 10 in remaining upright. In the depicted embodiment, the male inserts 210 and 212 project generally vertically from the skateboard 208. As such, the male inserts 210 and 212 can be inserted into and frictionally engaged with the recesses 32 in the doll's feet 30. Alternatively or additionally, the skateboard 208 could have first and second generally horizontal projections 214 and 216 that could be engaged by the grip portions 28 of the hands 26 of the doll 10 so that the doll 10 can be disposed in a handstand configuration.

In any event, one using the air launch ramp arrangement 202 can begin by joining the doll 10 with the skateboard 208 in any desired configuration and orientation using one or more of the first, second, third, or fourth male inserts 210, 212, 214, or 216 and one or more of the hands 26 or feet 30. The user can then dispose the doll 10 and skateboard 208 atop the ramp 204 with at least one of the skateboard wheels in the furrow or furrows 206. Then, the user can push or apply a puff of air to the doll 10 and, additionally or alternatively, the skateboard 208 sufficient to induce the wheel or wheels of the skateboard 208 to roll from within the furrow or furrows 206 whereby the skateboard 208 will be able to roll and slide down the ramp 204 while traversing any bumps, lips, or other surface formations that are incorporated into the ramp 204.

Figure 15:
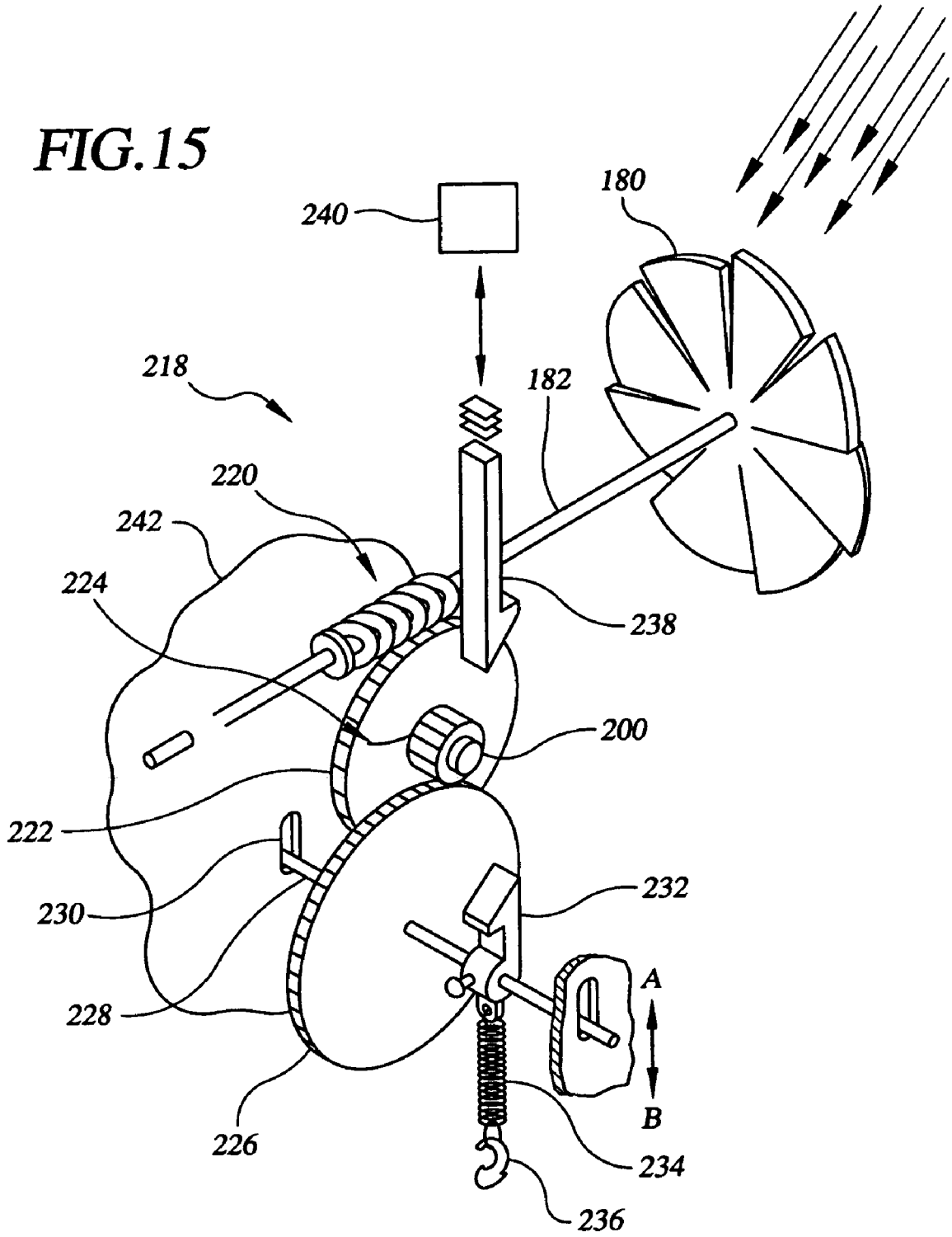
FIG. 15 is a perspective view of a fan release switch under the present invention.

Under the present invention, a puff or puffs of air can also be employed to actuate, activate, or trigger latches and switches wherein a preloaded element can be unlatched or released by the puff or puffs of air. Unless otherwise specified, within the terms of this disclosure, the terms actuate, activate, and trigger should be considered to be essentially equivalent and interchangeable. One switch arrangement comprises a fan release switch 218, which is shown in FIG. 15. The fan release switch 218 has a propeller fan 180 retained on a propeller shaft 182. A worm gear 220 is fixed to rotate with the propeller shaft 182 and meshes with a drive gear 222 that is fixed to a driven shaft 200. A reduction gear 224 is also fixed to rotate with the driven shaft 200. A latch shaft 228 is rotatably and reciprocatably retained in shaft slots 230 of a housing 242, which can be of substantially any shape and size. A latch gear 226 is disposed on the latch shaft 228 in alignment with the reduction gear 224, and a release hook latch 232 is fixed to pivot with the latch shaft 228. A biasing member 234, such as a spring or an elastic member, has a first end coupled to the latch shaft 228 via the release hook latch 232 and a second end retained by a retaining member 236, which can comprise a portion of the housing 242. A tension hook latch 238 is reciprocatably retained, possibly by a portion of the housing 242, in alignment with the release hook latch 232. The tension hook latch 238 is coupled or formed integrally with a means 240 for imparting tension on the tension hook latch 238. That means 240 for imparting tension on the tension hook latch 238 could comprise any element or arrangement capable of doing so including, by way of example, gravity, a biasing member or arrangement, or any other means.

Under this arrangement, when the release hook latch 232 and the tension hook latch 238 are disengaged, the biasing member 234 will tend to bias the latch shaft 228, the latch gear 226, and the release latch 232 to the disengaged position B as is shown in FIG. 15. When the components are so situated, the latch gear 226 will be disengaged from the reduction gear 224 such that the fan 180 can rotate generally freely. However, when the tension hook latch 238 is pressed into engagement with the release hook latch 232 and sufficient tension is applied to the tension hook latch 238, the tension hook latch 232 will pull the release hook latch 232 and thus the latch shaft 228 along the shaft slots 230 until the latch shaft 228, the latch gear 226, and the release hook latch 232 reach the engaged position A where the latch gear 226 is engaged with the reduction gear 224.

When the fan release switch 218 is in the engaged position A, a sufficiently powerful puff of air on the fan 180 will cause it to rotate thereby inducing a rotation of the worm gear 220. The rotating worm gear 220 will cause a turning of the drive gear 222 and the reduction gear 224 and, therefore, the latch gear 226. When the latch gear 226 has exhibited a sufficient angular movement, the release hook latch 232 will pivot out of engagement with the tension hook latch 238 thereby allowing the tension on the tension hook latch 238 to pull it away from its engaged position while the biasing member 234 will pull the release hook latch 232, the latch shaft 228, and the latch gear 226 to the disengaged position B where the release hook latch 232 will be ready to be re-engaged with the tension hook latch 238. One skilled in the art will be aware that the fan release switch 218 can be used in a wide variety of circumstances to enable a user to induce a switching or a release of substantially any element or arrangement by a simple puff of air.

Figure 16A:
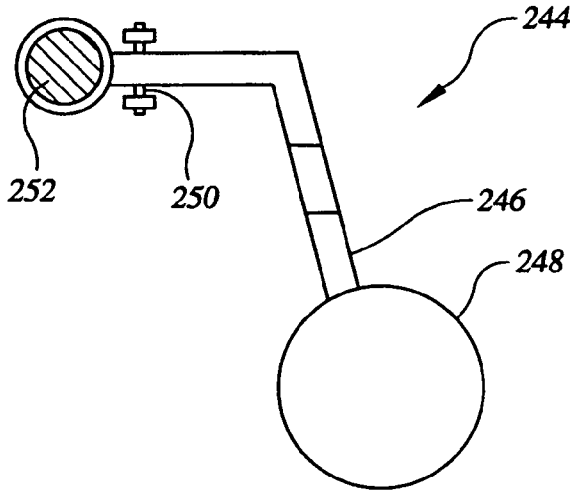
FIG. 16A is a top plan view of a counterbalance switch embodying the present invention.
Figure 16B:
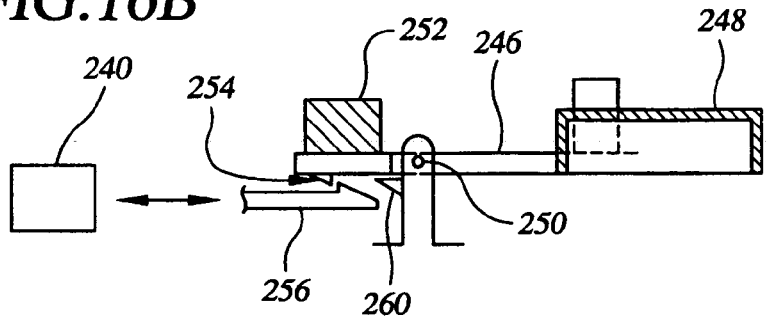
FIG. 16B is a view in side elevation of the counterbalance switch.
Figure 16C:
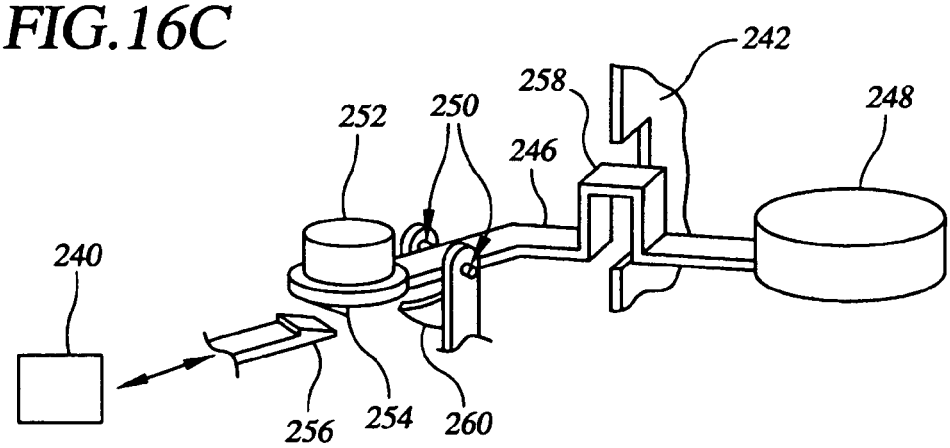
FIG. 16C is a perspective view of the counterbalance switch.

A further switch arrangement capable of being operated by air is shown in FIGS. 16A, 16B, and 16C in the form of a counterbalanced leverage switch 244 that has a leveraged arm 246 that is pivotable about a pivot axis 250 with first and second branches of the leveraged arm 246 disposed to opposite sides of the pivot axis 250. A puff surface 248, such as a cup, is fixed to a distal end of the first branch of the leveraged arm 246 while a counterweight 252 is fixed to a distal end of the second branch of the leveraged arm 246. In this exemplary embodiment, the counterweight 252 and the second branch of the leveraged arm 246 are calibrated to outweigh the puff surface 248 and the second branch of the leveraged arm 246 at least slightly. A stop surface 260 prevents the leveraged arm 246 from pivoting excessively. A release hook latch 254 is disposed on the second branch of the leveraged arm 246 in alignment with a reciprocatable tension hook latch 256 that is coupled or formed integrally with a means 240 for imparting tension on the tension hook latch 256.

Under this construction, the counterbalanced leverage switch 244 can be operated by a user's first engaging the tension hook latch 256 with the release hook latch 254. Then, the user can simply impart a puff of air upon the puff surface 248 to cause the leveraged arm 246 to pivot whereby the release hook latch 254 will pivot away from and release the tension hook latch 256. With this, the switch will have been tripped to allow the tension hook latch 256 and the means 240 for imparting tension to move away from the leveraged arm 246. The counterbalanced leverage switch 244 can be entirely exposed, or it could be employed with a portion of the switch 244 disposed within a housing 242, possibly in an otherwise difficult to access location. To facilitate such a disposition, the leveraged arm 246 can have a U-bend 258 therein.

Figure 17A:
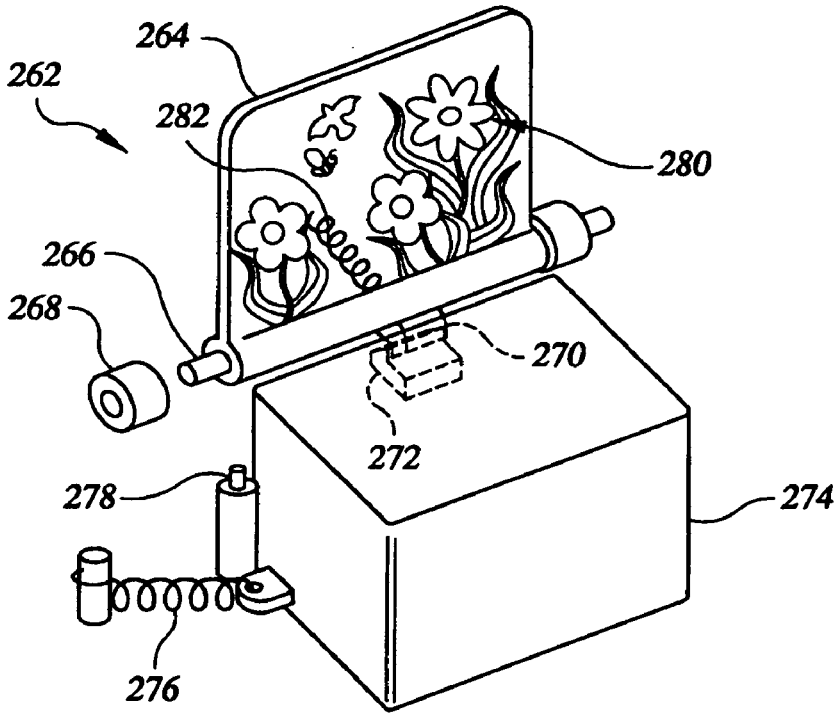
FIG. 17A is a perspective view of a puff sail switch pursuant to the present invention.
Figure 17B:
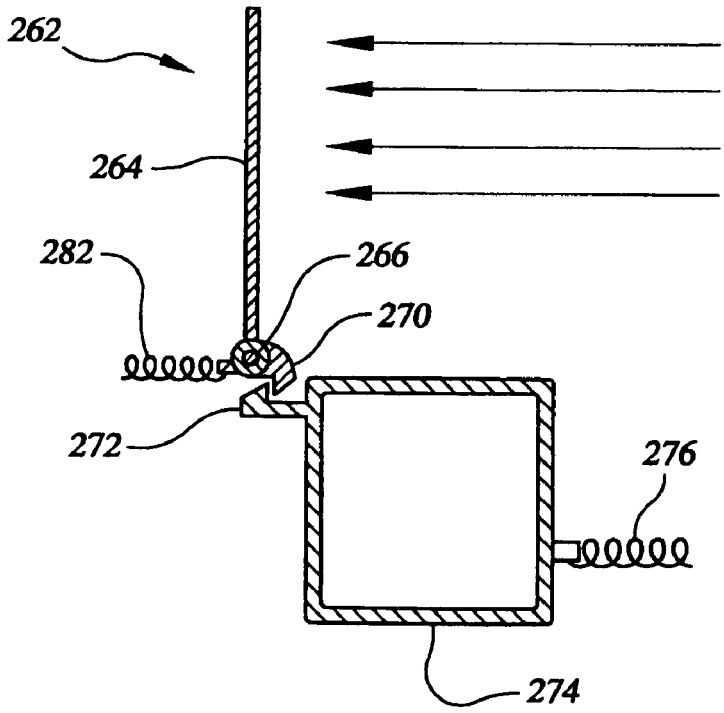
FIG. 17B is a partially sectioned view in side elevation of an alternative embodiment of the puff sail switch.

Yet another switch capable of being operated by air is depicted in FIGS. 17A and 17B where it comprises a puff sail switch 262. As its name would suggest, the puff sail switch 262 incorporates a sail member 264, which could be formed of substantially any material and with substantially any shape. As such, the sail member 264 could be formed from a flexible material, such as a textile, a rigid material, such as a plastic, metal, or wood, or from substantially any other type of material. In this exemplary embodiment, the sail member 264 is formed from a plastic, which can be generally transparent and possibly with decorations 280 disposed thereon. The sail member 264 can pivot about an axle 266 within one or more pivot bearings 268 and can be biased to a given orientation by a biasing member 282, such as a coil spring or an elastic member. A sail latch 270 can be fixed to pivot with the sail member 264 to align with a biased member latch 272 that is fixed to a biased structure 274. When the sail latch 270 and the biased member latch 272 are engaged, they can cooperate to prevent the biased structure 274 from moving in response to a motive force, such as a biasing force exerted by a biasing member 276. The biasing member 276 can tend to move the biased member 274 in any manner, such as in a pivoting motion about a pivot axis 278 as is shown in FIG. 17A or in a straight motion as would be the case in the embodiment of FIG. 17B.

It will be again noted that the sail member 264 could take substantially any form and theme. The sail member 264 could be crafted to simulate an actual sail on a toy boat, and it could be used as a trigger mechanism for a power source to induce the boat or other mechanism into movement in response to a puff of air. In another example, the sail member 264 could take the shape of a flag and could be used to trigger a power source on a toy vehicle to induce it into motion by a puff of air on the flag. Still further, the sail member 264 could be a sign in a playset. Of course, numerous other arrangements might occur to one after reading this disclosure.

Still other switching arrangements are contemplated wherein electronic signals can be induced by a user's imparting a current of air on a structural element of the switching arrangement thereby causing that structural element to move. Because the switches that will be described below can detect and respond to a change in location or orientation of a structural element in response to an air current, each can be termed a smart switch. Numerous results and effects can be achieved employing the smart switches of the present invention. For example, certain elements can be switched on and off by smart switches. Furthermore, electronic signals induced by smart switches can be interpreted by electronics incorporated into a playset element or configuration to induce various effects including sounds, lights, and actions both within dolls 10 and within or relative to other components of a playset. For example, by exploitation of smart switches under the present invention, a doll 10 that might be too small to reasonably retain necessary elements, such as batteries, sound chips, speakers, and electronics, can nonetheless induce desired effects by its own movements or by movement of associated components. As such, sound effects based on a doll's configuration, orientation, or location can magically seem to come from a doll 10 while actually coming from a related playset component. The doll's 10 being the apparent source of the sounds can be reinforced since the content and, additionally or alternatively, the timing of the sounds can be made to correspond to the actions of the doll 10.

In particular embodiments, the doll 10 can incorporate electrical contacts to enable a variety of functions as will be elaborated upon herein. For example, as FIGS. 2A, 2B, 18A, 18B, and 18C show, wiring 284 can be incorporated into the doll 10, possibly spanning from the grip portion 28 of one or both of the doll's hands 26 to the recess 32 of one or both of the doll's feet 30. Positive and negative leads 284A and 284B can be electrically coupled to an electrical contact or contacts 286 in the recess 32 or in the grip portion 28 as the case may be. Also, the male inserts or projections, such as that indicated at 84, can incorporate a corresponding conductive electrical contact or contacts 288, which can be spring loaded to ensure proper electrical contact. Playset wiring 292 can be electrically coupled to the electrical contact or contacts 288 and can lead to an electronic control arrangement 294. By use of the electrical contacts 286 and 288, the doll 10 can be caused to active various electronic, light, sound, and movement effects in the doll 10, a playset arrangement, or playset accessories.

Figure 18A:
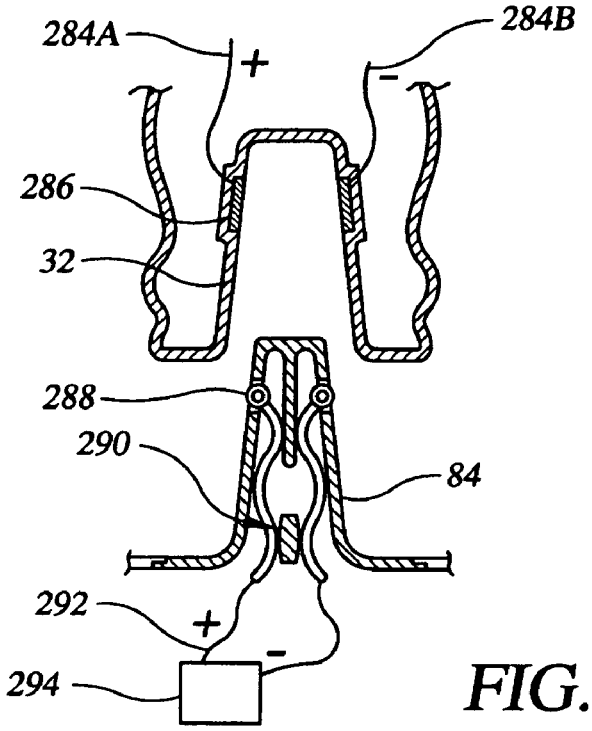
FIGS. 18A, 18B, and 18C are sectioned views in side elevation of embodiments of electrical couplings between a recess and a projection.
Figure 18B:
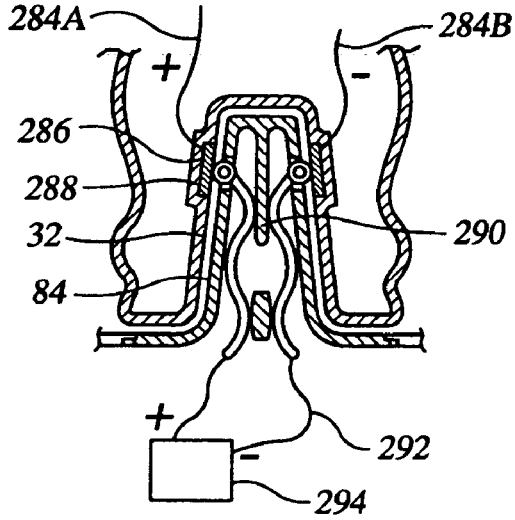
Figure 18C:
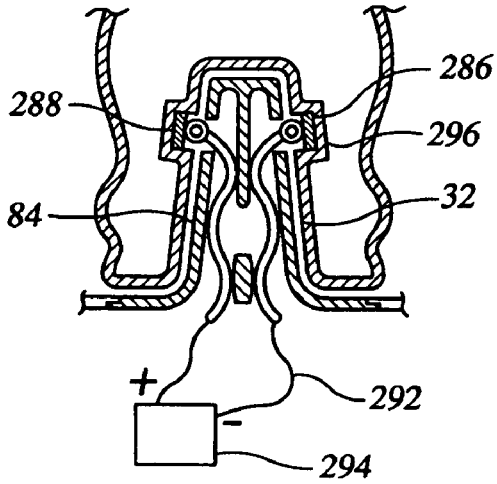

In a variation of the electrical contact arrangement, the electrical contact or contacts 286 in the recess 32 or the grip portion 28 can be disposed in a crank fit locking indentation 296 as is shown in FIG. 18C. Under such a construction, the spring loaded electrical contact or contacts 288 of the male insert or projection 84 can engage the locking indentation or indentations 296. With that, the doll 10 and the projection 84 can be lockingly engaged such that the doll 10 can crank or drive the playset element coupled to the projection 84, so that the playset element can be employed to crank or drive the doll 10, or simply to prevent relative rotation of the projection 84 and the recess 32 or grip portion 28. To allow the recess 32 or grip portion 28 to be disengaged from the projection 84 when desired, the electrical contact or contacts 288 can be rounded or wheeled. It will be appreciated that the cranking or driving arrangement could be readily carried out without electrical wiring.

In any event, a first type of smart switch is depicted in FIGS. 19A through 19D where the pendulum or swing arrangement 164 depicted in FIGS. 12A through 12C incorporates electrical wiring to allow playset effects to be induced based on the angular orientation of the loop 168 of the support member 166 relative to the bearing surface 170. To accomplish this, an electrical contact 298 is incorporated into the loop 168 for overlying the bearing surface 170 while first and second electrical leads 300 and 302 are angularly spaced along the bearing surface 170. The electrical leads 300 and 302 are operably associated with electronics (not shown) within a playset component.

Figure 19A:
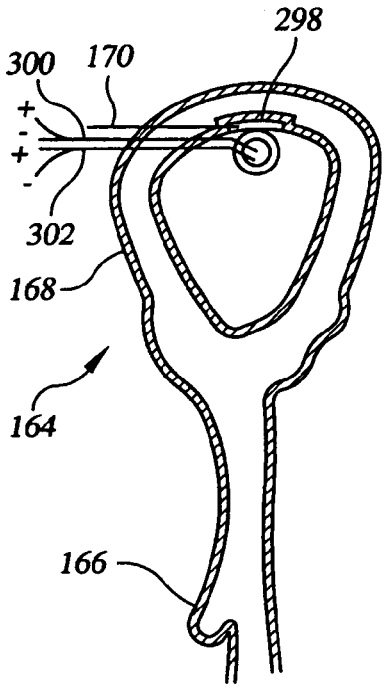
FIGS. 19A, 19B, and 19C are sectioned views in side elevation of a swing type smart switch under the present invention.
Figure 19B:
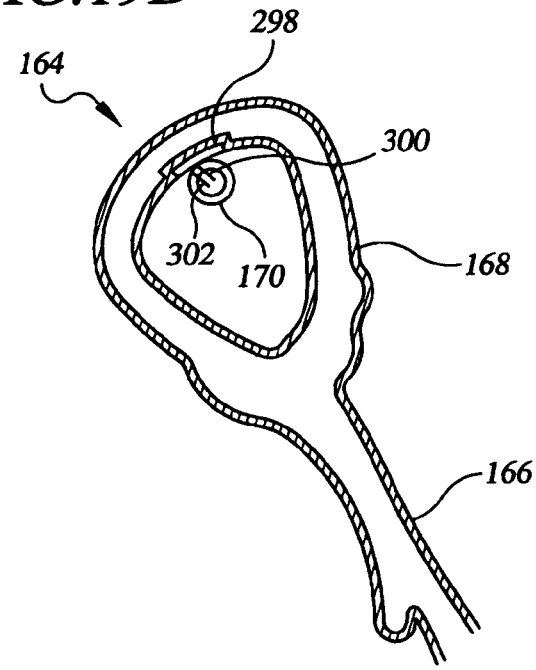

In an exemplary operation of such a construction, the activated play effect, which could be one or more of a sound, light, movement, or other effect, could be off when the support member 166 is vertically disposed, such as it would be at rest, where the electrical contact 298 on the loop 168 does not contact either electrical lead 300 or 302 as is shown in FIG. 19A. However, when the support member 166 is angularly deflected a sufficient amount, such as to the orientation shown in FIG. 19B, the electrical contact 298 on the loop 168 will make contact and complete a circuit with the first electrical lead 300 but not the second electrical lead 302. With that, the swing arrangement 164 can effectively sense the changed disposition of the support member 166, and a corresponding signal can be sent to the playset electronics. The playset electronics can then induce one or more effects, and that effect or effects can, if necessary or desirable, be tailored to the angular orientation of the support member 166. By way of example, the effect could be an audible effect that might correspond to a slight swinging movement, such as, "Ha. Ha. Rope swinging is really fun. Hee. Hee".

Figure 19C:
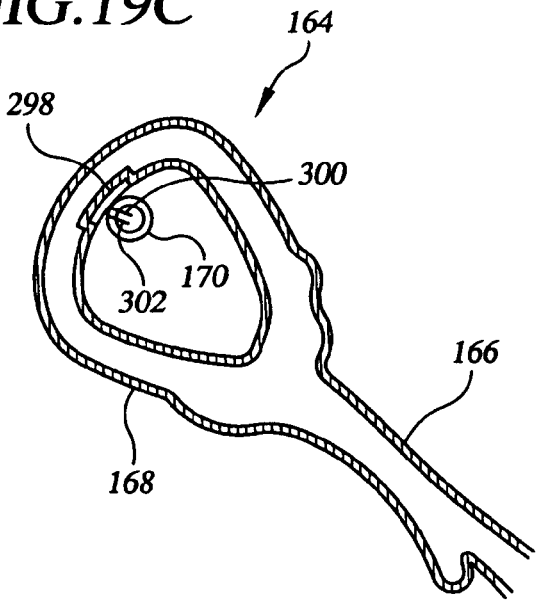
Figure 19D:
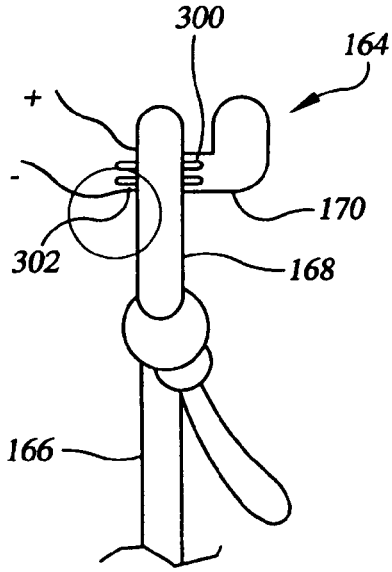
FIG. 19D is a view in front elevation of a portion of the swing type smart switch of FIGS. 19A through 19C.

When the loop 168 is induced into a greater angular displacement, such as is shown in FIG. 19C, the electrical contact 298 on the loop 168 will make contact with both the first and second electrical leads 300 and 302 such that the electronics can sense and interpret that greater amplitude swinging. Based on that sensing, the playset electronics can induce a different effect that can be indicative of the extended swing path. For example, an audible effect could be produced, such as, "Wow, I think I'm swinging too high now. Better slow down." Of course, the types and content of the effects could vary infinitely within the scope of the invention. It will also be clear that the present smart switch arrangement could be incorporated in numerous other arrangements, which may or may not swing or rotate in a vertical plane. Still further, it will be appreciated that further or fewer electrical leads could be employed. Furthermore, the playset electronics can discern the time between successive contacts to determine whether and, if so, how fast and how long the swing arrangement 164 is or has been operating and can induce or prevent corresponding play effects, such as sounds, lights, or movements, based on that information that can relate to the nature of movement of the swing arrangement 164.

Figure 20A:
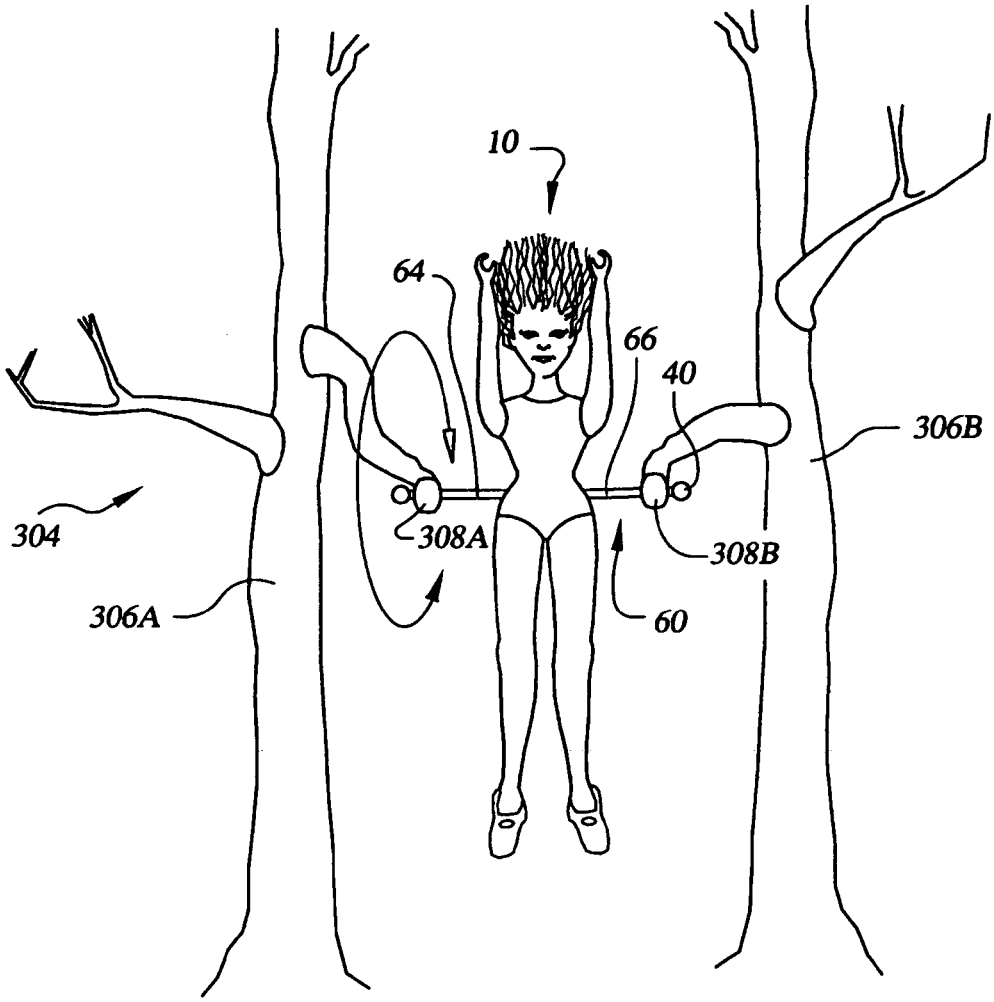
FIG. 20A is a view in front elevation of a tumble type smart switch according to the present invention.
Figure 20B:
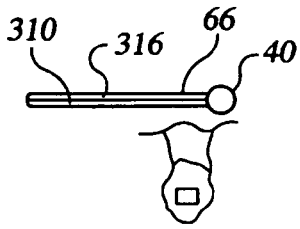
FIG. 20B is a view in front elevation of a portion of a tumble baton carrying forth the tumble type smart switch.
Figure 20C:
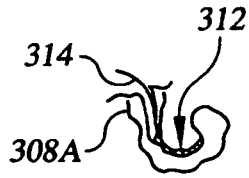
FIG. 20C is a view in side elevation of a bearing support carrying forth the tumble type smart switch.

Many of the same principles can be incorporated into a playset arrangement where the doll 10 is able to spin or tumble, such as by use of a tumble baton 34 as is shown in FIGS. 3A and 3B or by use of a tumble garment 60 as is depicted in FIGS. 4A and 4B. For example, in FIGS. 20A, 20B, and 20C, a doll 10 is shown with a tumble garment 60 snapped thereon whereby the center of gravity of the doll 10 can be calibrated to demonstrate most effective tumbling. The first and second lateral shafts 64 and 66 or the tumble baton 34 can be rotatably supported by curved bearing surfaces 308A and 308B such that the doll 10 can be caused to tumble by being pushed, by a simple puff or puffs of air, or by any other appropriate method. One or both of the first and second lateral shafts 64 and 66 or the shaft 36 can be encased in an insulative coating 316 except for one or more longitudinally exposed strands 310 of electrically conductive material while the corresponding bearing surface or surfaces 308A and 308B can incorporate an electrically conductive contact 312 with a wire lead 314 leading to the playset electronics.

Under this arrangement, the doll 10 with the tumble baton 34 or tumble garment 60 appropriately retained can be supported by the first and second bearing surfaces 308A and 308B and induced into rotation by any appropriate method. As the doll 10 rotates, the exposed strand or strands 310 will make intermittent contact with the electrically conductive contact 312 thereby intermittently completing an electrical circuit. With that, the playset electronics can interpret the angular orientation and angular velocity of the doll 10 and can produce effects, such as sounds, lights, movements, and, additionally or alternatively, any other possible effects, that can be based on the angular orientation and/or velocity of the tumbling doll 10. Of course, other playset configurations and rotatable constructions are possible and well within the scope of the invention.

Figure 21A:
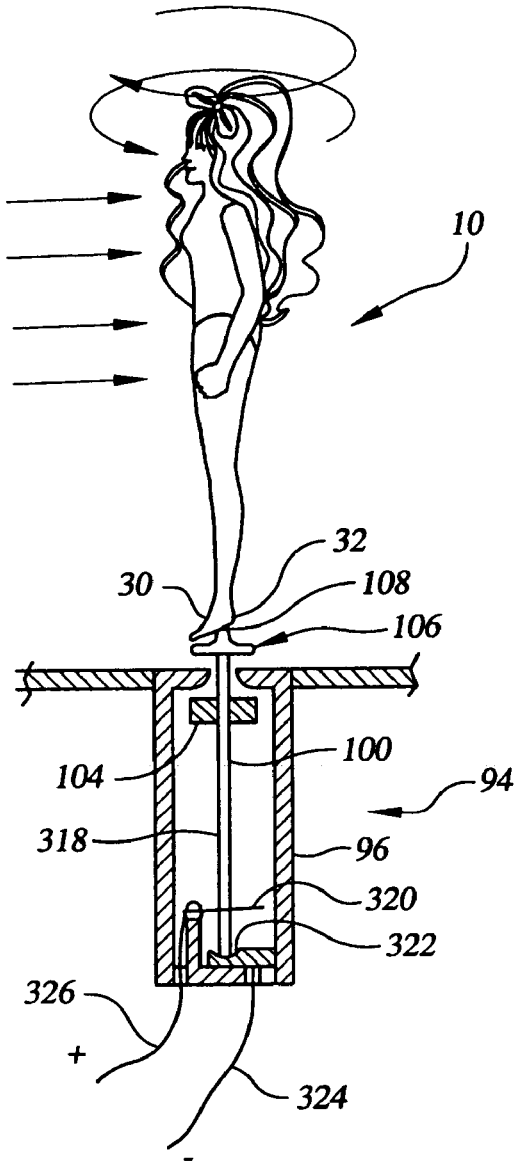
FIGS. 21A and 21B are sectioned views in front elevation of a vertical stand type smart switch according to the present invention with a retained doll in different angular orientations.
Figure 21B:
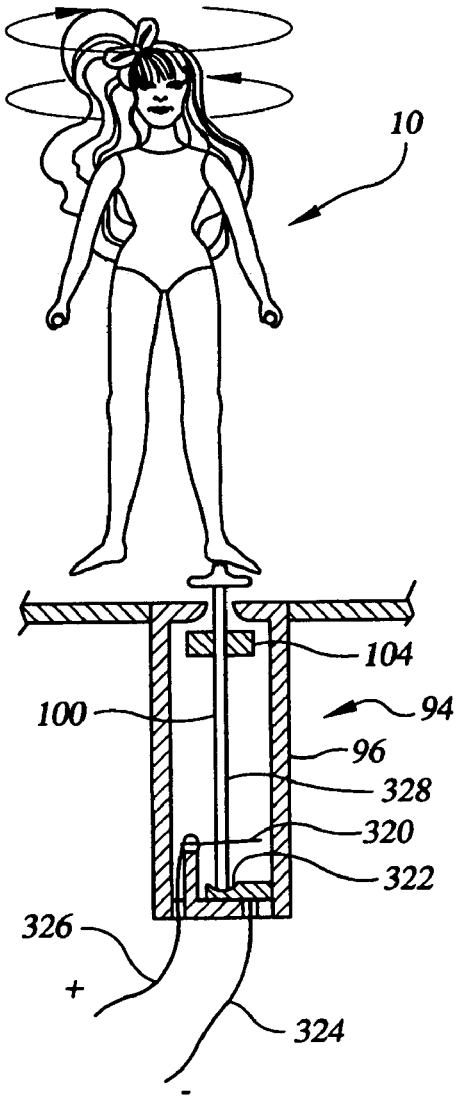

A further embodiment of the smart switch can be incorporated into a construction of the vertical stand 94 depicted first in FIGS. 7A through 7C and now incorporating a smart switch in FIGS. 21A and 21B. As such, the vertical stand 94 again has a vertically disposed axle 100 rotatably retained within a housing 96. An axle retainer 104 surrounds the axle 100 to maintain it in a vertical disposition and to prevent its inadvertent escape from the housing 96. A doll retaining member 106 with a vertical projection 108 is coupled to an upper end of the axle 100 for rotation therewith. The lower end of the axle 100 is rotatably supported by a conductive axle support 322 at the lower end of the housing 96. The axle 100 has an insulative coating 318 over its entire periphery except for one or more longitudinally communicating exposed conductive strands 328. An electrically conductive contact 320 is biased into contact with the axle 100. A first wire lead 326 extends from the contact 320 while a second wire lead 324 extends from the axle support 322.

With this, when a doll 10 disposed on such a vertical stand 94 is induced into rotation, whether by being pushed, blown upon, or otherwise compelled, the axle 100 will also rotate. As it does so, the electrically conductive strand or strands 328 will make intermittent contact with the contact 320 thereby intermittently completing an electrical circuit. As a result, the playset electronics can sense the speed and duration of the angular rotation and the disposition of the axle 100 and, thus, the doll 10 and can induce sound, light, visual, and motion effects based thereon.

Figure 22A:
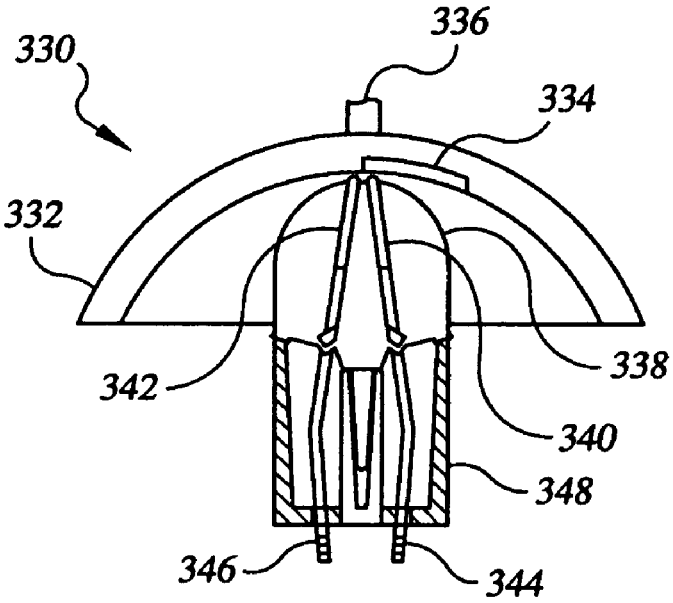
FIG. 22A is a sectioned view in side elevation of a flying balance type smart switch according to the present invention.
Figure 22B:
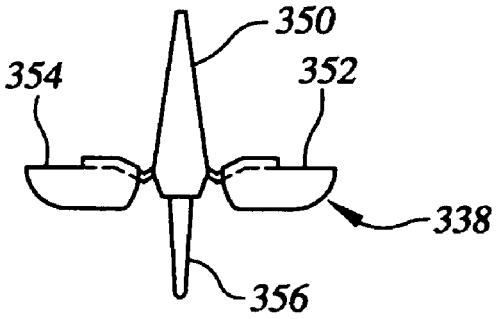
FIG. 22B is a view in side elevation of a support tip portion of the flying balance type smart switch.
Figure 22C:
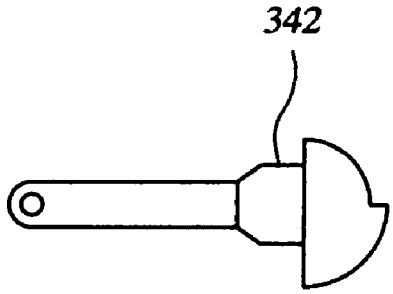
FIG. 22C is a view in side elevation of a conduct insert portion of the flying balance type smart switch.

Another variant of the smart switch can be employed in embodiments of the invention wherein a pivot cap rotatably overlies a support member, such as is shown, for example, in FIGS. 6A and 6B, 8A through 8D, and 9A through 9C. What can be termed a flying balance switch 330 is depicted in FIGS. 22A through 22C. The flying balance switch 330 has a bearing cap 332 with an electrical contact 334 and a doll connector 336 for supporting a doll accessory (not shown). A support tip 338 rotatably supports the bearing cap 332 that has first and second electrical contacts 340 and 342 along its surface. Of course, fewer or more electrical contacts 334, 340, and 342 could be provided.

The first and second electrical contacts 340 and 342 are coupled by electrical leads 344 and 346 to playset electronics (not shown). Employing this arrangement, the orientation and angular velocity of the bearing cap 332 can be sensed and interpreted by the playset electronics based on electronic signals produced when the electrical contact 334 of the bearing cap 332 makes contact with one of the electrical contacts 340 and 342 of the support tip 338. As before, the playset electronics can induce various effects based on the perceived orientation, angular speed, and other characteristics of the doll 10.

Of course, the construction of the support tip 338 could vary widely within the scope of the invention. In this exemplary embodiment, the support tip 338 is supported by a support cup 348. The support tip 338 is formed by a center member 350 that has first and second lateral members 352 and 354 hingedly coupled thereto and a male projection extending downwardly therefrom. The first and second electrical contacts 340 and 342 are formed by correspondingly numbered first and second conductive metal inserts. As is shown in FIG. 22C relative to the second electrical contact 342, the first and second electrical contacts 340 and 342 have a body portion for being passed through slots between the center member and the first and second lateral members 352 and 354 and a tip portion matching the profile of the support tip 338.

Figure 23A:
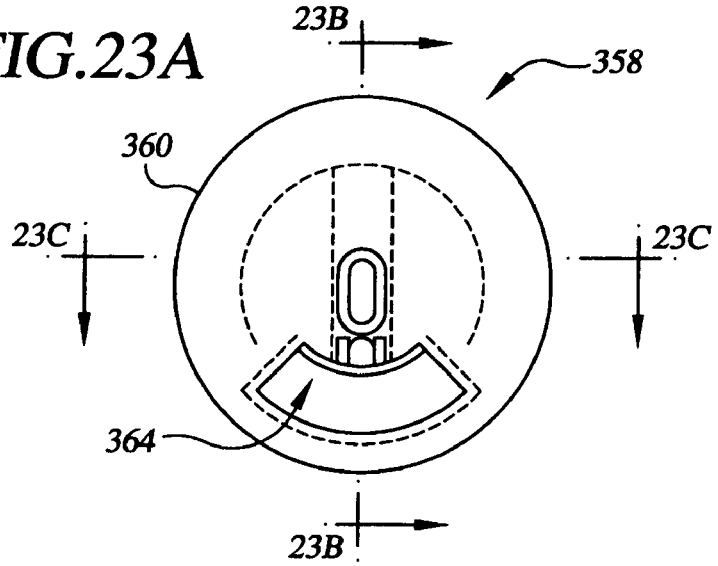
FIG. 23A is a top plan view of a puff sail type smart switch according to the present invention.
Figure 23B:
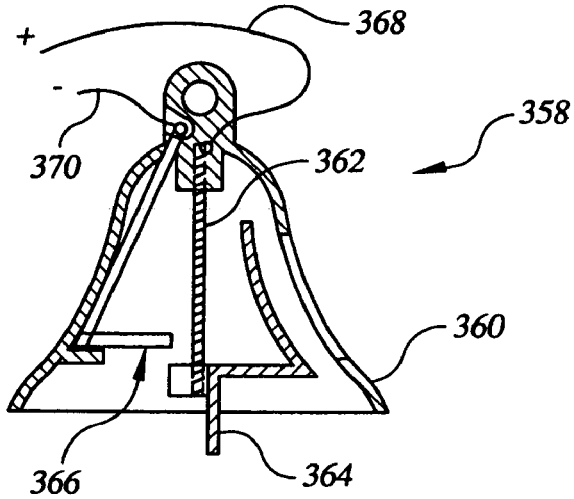
FIGS. 23B and 23C are side and front elevational views of the puff sail type smart switch of FIG. 23A.
Figure 23C:
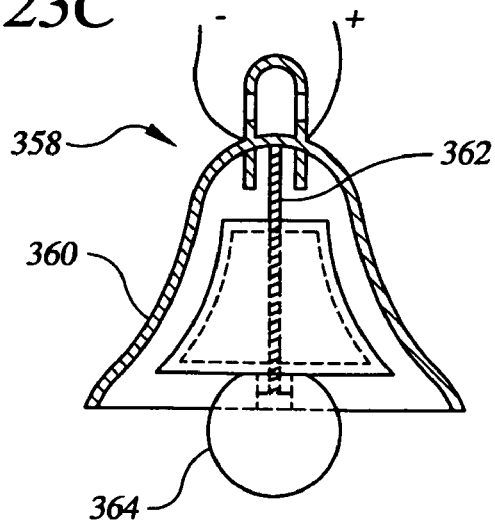

An even further smart switch takes the form of a puff sail switch, which is indicated generally at 358 in FIGS. 23A, 23B, and 23C. While the puff sail switch 358 could assume substantially any configuration or portion of a complete arrangement, the exemplary puff sail switch 358 is embodied in a structure simulating a bell. As such, the puff sail switch 358 has a simulated bell casing 360 with a missing casing portion. A sail 364, which simulates at least part of the missing casing portion and the bell pendulum, is supported by a resiliently deflectable, electrically flexible conductive member 362. An electrical contact 366 is retained relative to the bell casing 360 in proximity to the flexible conductive member 362.

With such a puff sail switch 358 provided, a user can impart a puff of air onto the sail 364 thereby to induce the flexible conductive member 362 to deflect into temporary contact with the electrical contact 366. With that, the electrical circuit will be completed thereby causing a signal to be sent to the playset electronics that the puff sail switch 358 has been triggered. The playset electronics can then induce any one of a variety of effects including, for example, an on/off switching function, a bell ringing sound, or other replicated sounds, lighting effects, or movements that can be based on the time and frequency of contact between the flexible conductive member 362 and the electrical contact 366. Again, it will be appreciated that the appearance of the puff sail switch 358 is of little consequence and could vary widely within the scope of the present invention.

With a plurality of exemplary embodiments of the present invention for switching arrangements and accessories that are capable of being activated or triggered by the application of one or more puffs or currents of air disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all features of the preferred embodiments.

Therefore, the following claims are intended to define the scope of protection to be afforded to the inventors. However, those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also equivalents thereof.

We claim as deserving the protection of Letters Patent:

1. A switching arrangement capable of being actuated by an application of an air current, the switching arrangement comprising:

a playset component;

a means for receiving an application of an air current relative to the playset component wherein the means for receiving an application of the air current is movable in response to the application of the air current; and a means for actuating a response to a movement of the means for receiving an application of the air current wherein the means for actuating a response to the movement of the means for receiving the application of the air current comprises a means for sensing the movement of the means for receiving the application of the air current and a means for producing an electrical signal in response to a sensed movement.

2. The switching arrangement of claim 1 wherein the switching arrangement comprises a pivotable switch wherein the means for receiving an application of an air current comprises a pivotable element supported by a playset component and wherein the means for sensing the movement of the means for receiving the application of the air current comprises a means for sensing a change in angular disposition of the pivotable element.

3. The switching arrangement of claim 2 wherein the means for sensing the change in angular disposition of the pivotable element comprises a means for differentiating between at least a first angular disposition and a second angular disposition.

4. The switching arrangement of claim 3 wherein the means for producing the electrical signal in response to the sensed movement comprises a means for producing an effect that is dependent on the angular movement of the pivotable element.

5. The switching arrangement of claim 1 wherein the switching arrangement comprises a rotatable switch wherein the means for receiving an application of an air current comprises a rotatable element supported by a playset component and wherein the means for sensing the movement of the means for receiving the application of the air current comprises a means for sensing a change in angular orientation of the rotatable element.

6. The switching arrangement of claim 5 wherein the rotatable element is supported by the playset component by an axle and wherein the means for sensing the change in angular orientation of the rotatable element comprises an electrical contact that is biased into contact with the axle and at least one exposed conductive portion on the axle.

7. The switching arrangement of claim 5 wherein the means for producing the electrical signal in response to the sensed movement comprises a means for producing an effect that is dependent on an angular disposition of the rotatable element.

8. The switching arrangement of claim 5 wherein the means for producing the electrical signal in response to the sensed movement comprises a means for producing an effect that is dependent on an angular rotation of the rotatable element.

9. The switching arrangement of claim 5 wherein the means for sensing the movement of the means for receiving the application of the air current comprises a means for sensing a contact history between the first electrical contact and the second electrical contact and for producing an effect that is dependent on that contact history.

10. The switching arrangement of claim 1 wherein the playset component comprises a doll for receiving an application of an air current and wherein the means for actuating a response to a movement of the means for receiving an application of the air current comprises a means for sensing a movement of the doll and a means for producing an electrical signal in response to a sensed movement.

11. The switching arrangement of claim 10 further comprising a doll accessory, an engaging means associated with the doll body, and an engaging means associated with the doll accessory wherein the engaging means associated with the doll body and the engaging means associated with the doll accessory cooperate to comprise a means for creating a mating engagement between the acrobatic doll body and the doll accessory.

12. The switching arrangement of claim 11 wherein the engaging means associated with the doll body comprises one of a reception volume with a given shape and size and a projection with a given shape and size and wherein the engaging means associated with the doll accessory comprises the other of the reception volume and the projection.

13. The switching arrangement of claim 12 wherein the engaging means associated with the doll body comprises a reception volume and wherein the engaging means associated with the doll accessory comprises a projection.

14. The switching arrangement of claim 12 wherein the means for sensing movement of the doll and the means for producing an electrical signal in response to a sensed movement comprise an electrical contact disposed in operable association with the reception volume in electrical combination with an electrical contact disposed in operable association with the projection.

15. The switching arrangement of claim 14 wherein the reception volume and the projection have substantially matching tapers.

16. The switching arrangement of claim 15 wherein the doll has a body with a hand and a foot and wherein the reception volume comprises a portion of the hand or foot.

17. A switching arrangement comprising:

a doll body;

an engaging means associated with the doll body;

a doll accessory;

an engaging means associated with the doll accessory; means for receiving an application of an air current relative to the playset component wherein the means for receiving an application of the air current is movable in response to the application of the air current; and a means for actuating a response to a movement of the means for receiving an application of the air current and a means for sensing the doll body in relation to the doll accessory and a means for producing an electrical signal in response thereto;

wherein the means associated with the doll body and the engaging means associated with the doll accessory cooperate to comprise a means for creating a mating engagement between the acrobatic doll body and the doll accessory.

18. The switching arrangement of claim 17 wherein the engaging means associated with the doll body comprises one of a reception volume with a given shape and size and a projection with a given shape and size and wherein the engaging means associated with the doll accessory comprises the other of the reception volume and the projection.

19. The switching arrangement of claim 18 wherein the engaging means associated with the doll body comprises a reception volume and wherein the engaging means associated with the doll accessory comprises a projection.

20. The switching arrangement of claim 18 wherein the means for sensing the doll body in relation to the doll accessory and the means for producing an electrical signal in response thereto comprise an electrical contact disposed in operable association with the reception volume in electrical combination with an electrical contact disposed in operable association with the projection.

21. The switching arrangement of claim 20 wherein the reception volume and the projection have substantially matching tapers.

22. The switching arrangement of claim 20 wherein the doll body has a hand and a foot and wherein the reception volume comprises a portion of the hand or foot.

* * * * *